US007950599B1

(12) United States Patent
Burkhardt

(10) Patent No.: US 7,950,599 B1
(45) Date of Patent: May 31, 2011

(54) HOSE CONTROLLED SPRINKLER DEVICE AND CONTROL METHOD THEREFOR

(76) Inventor: George Wayne Burkhardt, San Antonio, TX (US)

( * ) Notice: Subject to any disclaimer, the term of this patent is extended or adjusted under 35 U.S.C. 154(b) by 273 days.

(21) Appl. No.: 12/284,782

(22) Filed: Sep. 25, 2008

Related U.S. Application Data

(60) Provisional application No. 60/997,152, filed on Oct. 1, 2007.

(51) Int. Cl.
*B05B 1/30* (2006.01)
*B05B 3/00* (2006.01)
*B05B 15/06* (2006.01)
*F21S 8/00* (2006.01)

(52) U.S. Cl. ..... 239/581.1; 239/581.2; 239/582.1; 239/723; 239/19; 239/200; 239/275; 239/280

(58) Field of Classification Search ..... 239/723, 239/19, 69, 67, 576, 578, 562, 581.1, 582.1, 239/581.2, 200, 225.1, 273, 276, 285, 262, 239/264, 587.3, 587.4, 275, 280; 137/356; 251/149.8, 231, 341
See application file for complete search history.

(56) References Cited

U.S. PATENT DOCUMENTS 1,031,176 A * 7/1912 Gilpin ..... 239/276
1,731,555 A * 10/1929 Williams ..... 239/267
2,723,159 A * 11/1955 Nelson ..... 239/73
2,761,733 A * 9/1956 Preus ..... 239/562
2,830,614 A * 4/1958 Pralle ..... 137/356
5,813,655 A * 9/1998 Pinchott et al. ..... 251/129.04
6,283,139 B1 * 9/2001 Symonds et al. ..... 137/78.3
6,499,678 B1 * 12/2002 Hope ..... 239/581.1

* cited by examiner

*Primary Examiner* — Dinh Q Nguyen
*Assistant Examiner* — Steven M Cernoch

(57) ABSTRACT

A hose controlled sprinkler device, whose sequential liquid output states can be remotely controlled by a substantially unidirectional movement of a hose connected to the sprinkler device. The hose controlled sprinkler device includes a valve and at least one valve support. The valve includes a moveable member, a valve housing, an inlet connection configured for connection to the hose and an outlet connection. The valve is configured to have at least one liquid off state, a liquid on state, and a liquid off state output sequence at the outlet connection. The sequence is established by a pressurized liquid input at the inlet connection and further by a unidirectional movement of the movable member and the housing one about the other. The at least one valve support is connected to the valve and is configured to stabilize the valve above at least one of a ground and a lawn. The liquid output states of the hose controlled sprinkler device can be remotely controlled by the substantially unidirectional movement of the hose which is both connected to the inlet connection and supplies the inlet connection with a pressurized liquid. In other embodiments, a sprinkler is connected to the outlet connection of the hose controlled sprinkler device.

21 Claims, 17 Drawing Sheets

HOSE CONTROLLED SPRINKLER DEVICE AND CONTROL METHOD THEREFOR

CROSS-REFERENCE TO RELATED APPLICATIONS

This application claims the benefit of Provisional U.S. Patent Application Ser. No. 60/997,152. filed Oct. 1, 2007 by the present inventor.

FEDERALLY SPONSORED RESEARCH

None.

BACKGROUND

1. Field

This application relates to a hose controlled sprinkler device and control method therefor that provides for remote control of a liquid output from the hose controlled sprinkler device by a substantially unidirectional movement of a hose connected to the sprinkler device.

2. Prior Art

Watering a lawn, especially a large lawn requiring the use of a relatively long water hose(s), using a conventional sprinkler can be a laborious and time consuming task. The labor and effort required are compounded by having to turn the water on and off when moving the sprinkler to a new location in order to prevent the user from getting wet. The procedure for moving an operating sprinkler to a new location is usually accomplished by performing one of the two following procedures.

The first procedure is to walk to the sprinkler connected faucet and turn the water off, then walk to the sprinkler and move it to a new location, and finally, walk back to the faucet and turn the water back on. As can be visualized from using this procedure, considerable time and effort are required due to the relatively long walking distances involved, especially when the sprinkler is located far from the faucet.

The second procedure is to (1) walk to the hose outside of the sprinkling range and bend the hose approximately 180 degrees to pinch it and thereby, restrict the water flow, (2) then while holding the hose in the pinched condition, drag the hose while walking to the sprinkler, (3) next, while maintaining the pinched condition of the hose with one hand, pick up the sprinkler with the other hand and move to the next sprinkling location while holding the sprinkler and dragging the hose and then set the sprinkler down, and finally, (4) while still holding the pinched hose, walk away from the sprinkler dragging the hose until out of the sprinkling range and then releasing the pinch in the hose to turn the sprinkler back on. This second procedure does not usually require as much walking as the first procedure but still requires excessive hose and sprinkler manipulation and relatively extensive dragging of the sometimes long and heavy water filled pinched hose which are undesirable tasks. In addition, the hose pinching method used in the second procedure usually does not turn the water completely off so that the sprinkler continues to release water while in the act of holding and moving the sprinkler, which further compounds the problems in the second procedure.

In an attempt to overcome the problems of turning the water on and off at the faucet or pinching then dragging the hose, several prior art sprinklers and related devices have been developed; however, they all suffer from a number of deficiencies and drawbacks.

U.S. Pat. No. 2,830,614 issued Apr. 15, 1958 to Willaim F. Pralle presents a hose valve that can be attached to a sprinkler or lengths of hose whereby, the water can be turned on and off by swinging the valve input hose from side to side which in turn rotates a valve housing causing an internal valve disc to tilt to and from its seat resulting in the water flow through the valve being turned off and on, respectively. While this hose valve can provide for remote on-off water control outside of a sprinkling range of the sprinkler, thereby, keeping the user from getting wet, it has a number of major disadvantages, namely: (1) the valve has to be manually pushed into the ground, as an additional step, which is difficult to accomplish, especially if the ground is dry and hard, (2) whether the valve is connected directly to a sprinkler or an output hose, the valve input hose has to be swung over relatively long distances by walking in an extended arc about the valve, outside of the sprinkling range, in order to not get wet, (3) when swinging the hose about the valve in an unidirectional direction, the sequence of valve output states are an on state, an off state and an on state due to the inherent physical valve housing stops applicable to the on states, (4) when the valve is open, the valve disc is tilted from the valve seat which results in restricted water flow because water can only flow from one side of the valve, (5) the valve has to be connected to an existing sprinkler in order to provide a sprinkling function, and (6) the valve requires a number of moving parts which increases the cost and opportunities for malfunction.

U.S. Pat. No. 2,761,733 issued Sep. 4, 1956 to Irving J. Preus presents a garden sprinkler control system that permits sprinkled water output from the system to be on-off controlled outside of the sprinkling area. The control system includes a gate valve, a long flexible shaft, a rotatable handwheel and a sprinkler. One end of the flexible shaft is connected to a gate valve element of the gate valve and the other end is connected to the handwheel with the sprinkler being connected to the output of the valve. The input to the valve is connected to a water source. Rotating the handwheel in different directions makes the gate valve element move which in turn, makes the gate valve open and close; thereby turning the water flow to the sprinkler on and off, respectively. In order for a user to not get wet when changing sprinkler locations, the flexible shaft has to be longer than the sprinkling range radius so that the on-off states of the sprinkler can be remotely controlled outside of the sprinkling area. As with the previously stated U.S. Pat. No. 2,830,614 issued to Pralle, the garden sprinkler control system, described in U.S. Pat. No. 2,761,733, provides for remote on-off water control outside of the sprinkling range, but it has several major disadvantages, namely: (1) since the flexible shaft has to be relatively long, it would be awkward, bulky and laborious and therefore, not conducive to moving the control system and a control system connected hose to new sprinkling locations, (2) judging from the number of threads involved to move the gate valve to open and closed states, the handwheel would have to be rotated numerous times which makes the on-off sprinkler transition time relatively time consuming, (3) the sprinkler control system is relatively complex due to its many parts which increases the cost and opportunity for malfunction, (4) the sprinkler control system is heavy due to its complexity and long flexible shaft, and (5) to maintain functionality in a wet environment, the long flexible shaft would have to be made from corrosion resistant materials and/or sealed which also adds to the cost.

U.S. Pat. No. 5,813,655 issued Sep. 29, 1998 to Gordon A. Pinchott, Richard A. Nielsen, and John W. Rosenbloom and U.S. Pat. No. 6,283,139 issued Sep. 4, 2001 to Randall R. Symonds, David A. Paul, and Scott Jacobs present a remote control on/off valve and a remote controlled hose valve, respectively, which are examples of several patented devices that relate to the radio control of sprinkler operation. Radio controlled devices of this type usually include a transmitter and a receiver controlled valve. The receiver controlled valve is generally connected in series between a faucet and a water supply hose which is in turn connected to a sprinkler. In operation, a user usually carries the transmitter and pushes a button on the transmitter to signal the receiver controlled valve to change its output states; thereby, remotely turning the water flow to the sprinkler on and off as required during the sprinkling operation to prevent the user from getting wet when changing sprinkling locations. Since the valves are electronic devices, there are several disadvantages, namely: (1) electronic devices are expensive, (2) electronic devices require frequent replacement of batteries, (3) electronic devices are subject to significant malfunction and expensive to repair, due to the relatively large part count, (4) generally, the transmitter must be carried by the user, (5) the transmitter is subject to being easily lost or misplaced, and (6) both the transmitter and the receiver portion of the receiver controlled valve are subject to water ingress which is detrimental to the inherent electronic circuitry.

While these prior art sprinklers and related devices provide for remote on-off control of sprinklers to prevent users from getting wet when changing sprinkler locations, they all suffer from problems, deficiencies and/or drawbacks. Thus, there continues to remain a need in the art for an inexpensive, simple-to-use, user friendly, and reliable sprinkler device which provides for remote control of the output of a sprinkler, to prevent users from getting wet while changing sprinkler locations, that: (1) can provide remote sprinkler output control in an off state, an on state and an off state sequence by the substantially unidirectional pulling of the sprinkler device connected hose, (2) significantly reduces walking when changing sprinkler locations, (3) significantly reduces dragging of water hoses when changing sprinkler locations, (4) significantly reduces time required to change sprinkler locations, (5) requires a minimum number of parts, (6) integrates a sprinkler or is configured to connect to a conventional sprinkler, (7) does not require manually pushing into the ground, and (8) has a low probability of malfunction.

SUMMARY

In accordance with one embodiment of the present invention, a hose controlled sprinkler device, whose sequential liquid output states can be remotely controlled by a substantially unidirectional movement of a sprinkler device connected hose. The hose controlled sprinkler device includes a valve and at least one valve support. The valve includes a moveable member, a valve housing, an inlet connection configured for connection to the hose and an outlet connection. The valve is configured to have at least one liquid off state, a liquid on state, and a liquid off state output sequence at the outlet connection. The sequence is established by a pressurized liquid input at the inlet connection and further by a unidirectional movement of the movable member and the valve housing one about the other. The at least one valve support is connected to the valve and is configured to stabilize the valve above at least one of a ground and a lawn. The liquid output states of the hose controlled sprinkler device can be remotely controlled in the above sequence by the substantially unidirectional movement of the hose which is both connected to the inlet connection and supplies the inlet connection with a pressurized liquid.

In another embodiment, a sprinkler is connected to the outlet connection of the sprinkler device.

In yet another embodiment, a method for remote control of the sequential output states of a sprinkler pressurized with a liquid is presented.

It is the object of these and other disclosed embodiments, herein, to solve at least one of the afore mentioned problems and other problems inherent in the related prior art.

BRIEF DESCRIPTION OF THE DRAWING FIGURES

A better understanding of the embodiments of the hose controlled sprinkler device may be had by reference to the drawing figures wherein.

DETAILED DESCRIPTION OF THE EMBODIMENTS

This application relates to a hose controlled sprinkler device and control method therefor that provides for remote control of liquid output from the hose controlled sprinkler device by a substantially unidirectional movement of a liquid supply hose connected to the sprinkler device.

First Embodiment

Figure 1:
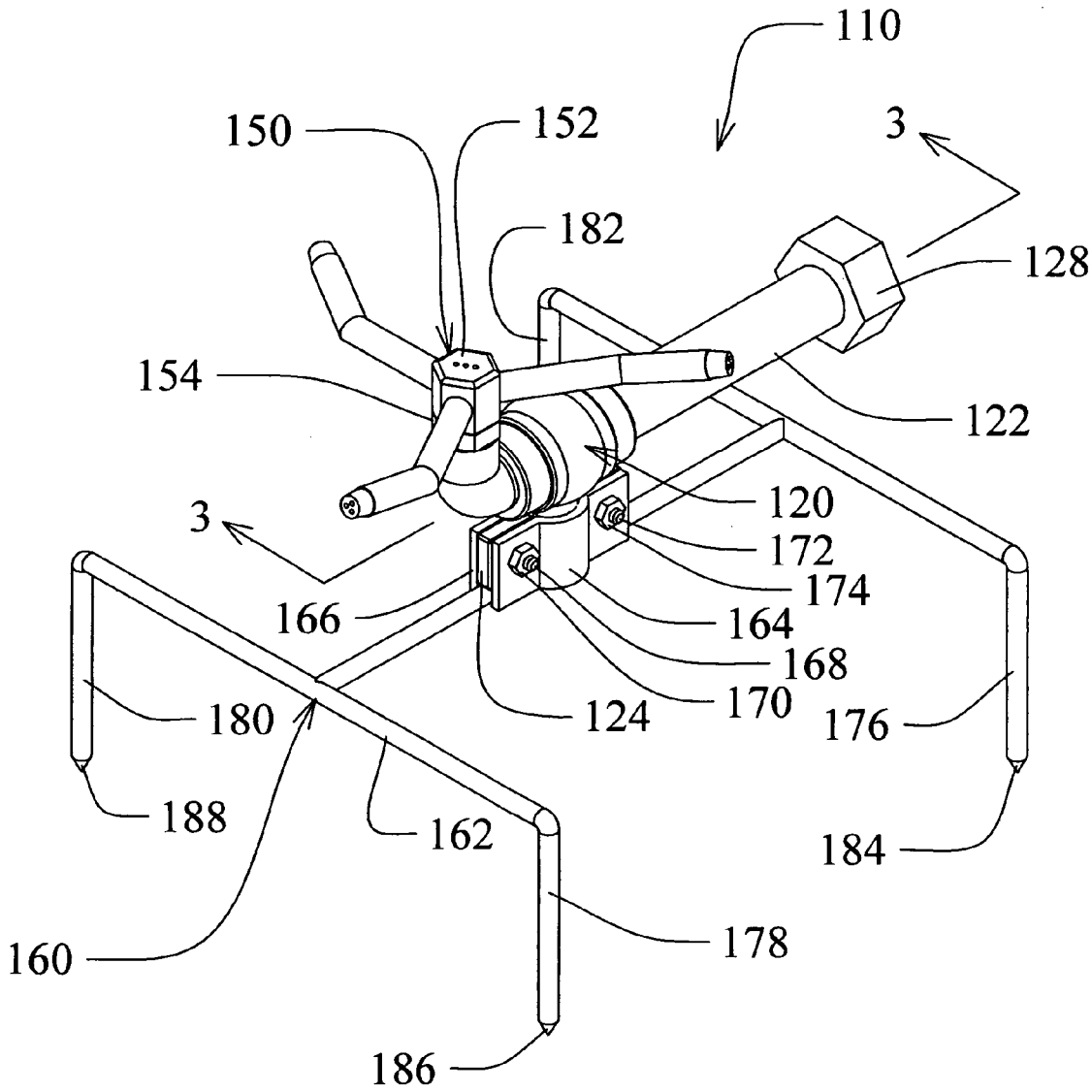
FIG. 1 is a side perspective view showing a first embodiment of the hose controlled sprinkler device.
Figure 2:
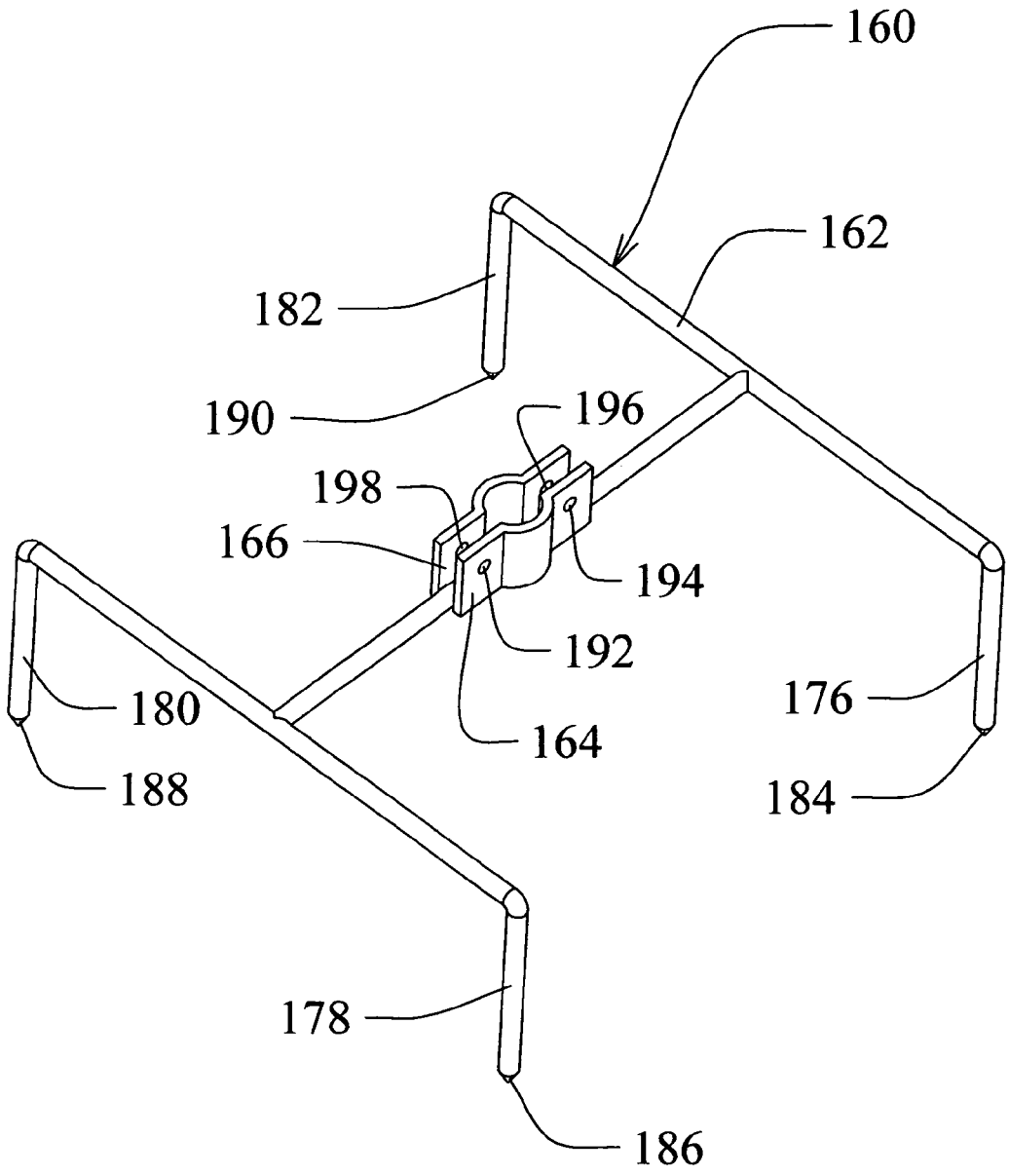
FIG. 2 is a side perspective view showing a support assembly of the first embodiment.
Figure 3:
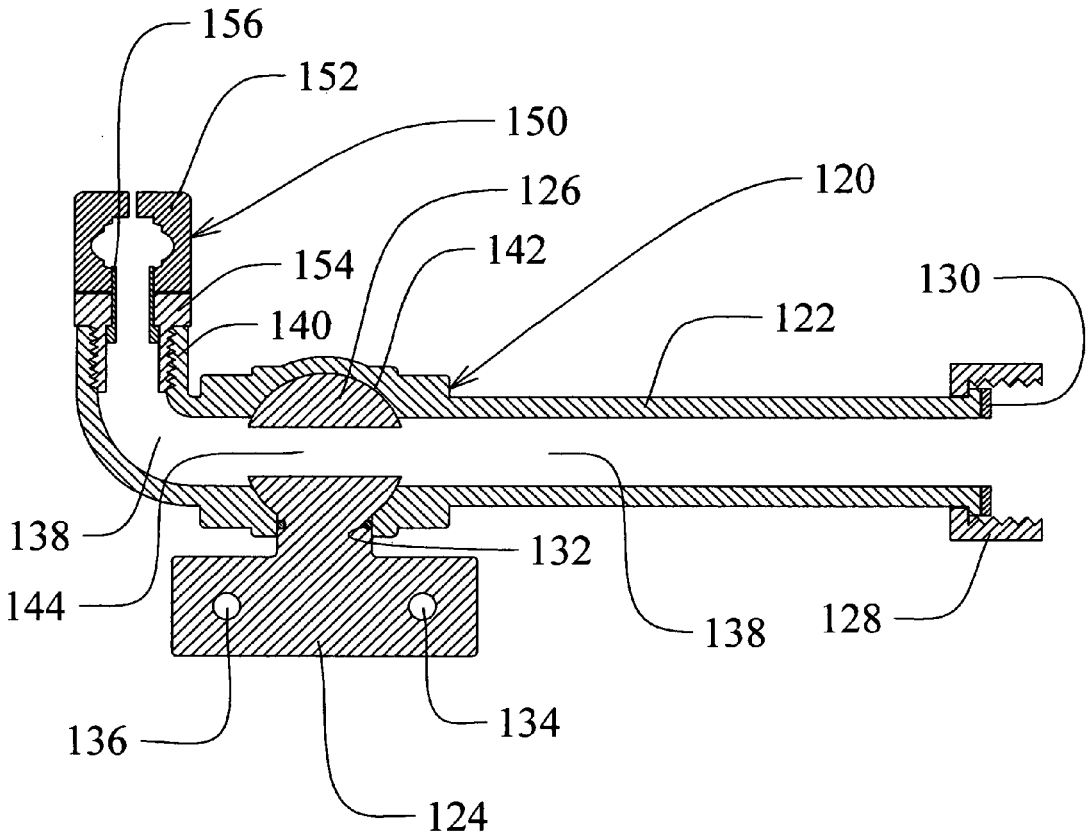
FIG. 3 is a sectional view showing a rotary valve assembly and a sprinkler head assembly of the first embodiment.

FIG. 1, FIG. 2, and FIG. 3

Referring to FIG. 1, FIG. 2, and FIG. 3 a first embodiment 110 of the hose controlled sprinkler device is shown. The first embodiment 110 includes a generic valve, an on-off valve, a rotary valve or a rotary valve assembly 120; a sprinkler head or a sprinkler head assembly 150; and a valve support or a valve support assembly 160.

The valve assembly 120 includes a valve housing 122 and a movable or a rotary valve member 126. The rotary valve member 126 includes a moveable or a rotary valve member extension or valve handle 124, a valve handle hole 134, a valve handle hole 136 and a liquid rotary passageway 144. The valve housing 122 includes an inlet port, connection or connector 128, an inlet connector washer 130, a valve housing liquid passageway 138, an outlet port, connection or connector 140, a valve shaft seal 132 and a housing cavity 142.

The rotary valve assembly 120 described above and shown in FIG. 3 is of the ball valve type and is used for illustration or reference only. The generic valve, the on-off valve, the rotary valve or the valve assembly 120 is defined more generically as a valve in which the output liquid flow from the valve can be controlled from an off state, to an on state, and to an off state by a unidirectional movement of an integrated valve member or first portion and an associated valve housing or second portion, one about the other, such as a ball valve, plug valve, butterfly valve, cock valve, control valve, crank valve, etc.

The sprinkler head assembly 150 includes a rotary sprinkler head 152, an inlet connector 154, and a rotary bushing 156.

The valve support assembly 160 includes a frame 162, a connection bracket 164, a connection bracket 166, a screw 168, a nut 170, a screw 172 and a nut 174. The frame 162 includes a valve support, a frame support or a frame leg 176, a valve support, a frame support or a frame leg 178, a valve support, a frame support or a frame leg 180, a valve support, a frame support or a frame leg 182, a leg point 184, a leg point 186, a leg point 188 and a leg point 190. The connection bracket 164 has a bracket hole 192 and a bracket hole 194. The connection bracket 166 has a bracket hole 196 and a bracket hole 198. The connection bracket 164 and the connection bracket 166 are attached to the frame 162, as shown in FIG. 2.

The rotary valve member 126 is positioned substantially within the housing cavity 142, except for the valve handle 124. The shaft seal 132 seals the valve member 126 to the valve housing 122. The inlet connector 128 is attached to or integrated into the valve housing 122 at one of its ends and the outlet connector 140 is attached to or integrated into the valve housing 122 at its other end. The inlet connector 128 provides for connection to a sprinkler or liquid supply hose 30 (see FIG. 4, FIG. 5, and FIG. 6) and the washer 130 provides a seal between the inlet connector 128 and the attached hose 30.

The liquid passageway 138 provides for liquid flow through the valve housing 122 and the liquid passageway 144 provides for liquid flow through the valve member 126. When the passageway 138 and the passageway 144 are substantially aligned, as when the valve member 126 is in the position shown in FIG. 3, liquid can flow substantially unrestricted from the inlet connector 128 to the outlet connector 140; however, when the valve member 126 is rotated in the housing cavity 142 approximately 70 to 110 degrees with respect to the valve housing 122, the liquid passageway 138 and the liquid passageway 144 are misaligned or discontinuous with respect to each other and liquid flow through the valve assembly 120 is terminated.

The rotary bushing 156 connects the sprinkler head 152 to the inlet connector 154 and permits rotation of the sprinkler head 152 about the inlet connector 154. The sprinkler head assembly 150 is connected to the valve housing 122 by screwing the inlet connector 154 into the outlet connector 140. The valve support assembly 160 is connected to the valve assembly 120 by placing the valve handle 124 between the connection bracket 164 and the connection bracket 166 and inserting the screw 168 through the holes 198, 136, and 192 and the screw 172 through the holes 196, 134, and 194. The nut 170 is then screwed onto the screw 168 and tightened and the nut 174 is screwed onto the screw 172 and tightened.

The valve support assembly 160 components, excluding the screw 168, the nut 170, the screw 172 and the nut 174, can be either welded, cast, molded, and/or formed into a single unit. The leg points 184, 186, 188, and 190 assist the frame 162 to engage with an associated lawn, garden or ground upon placement of the first embodiment 110 on the lawn, garden or ground.

The sprinkler head or the sprinkler head assembly 150 shown is just an illustration or representation of a generic sprinkler head or a sprinkler head assembly but could be any type of sprinkler head or sprinkler head assembly such as: an impact or an impulse sprinkler head or sprinkler head assembly; another type of rotary sprinkler head or sprinkler head assembly; a static sprinkler head or sprinkler head assembly; an oscillating sprinkler head or sprinkler head assembly; etc.

The sprinkler head or the sprinkler head assembly 150 is defined more generically as a sprinkler for this embodiment and all other embodiments herein. Furthermore, the term "liquid" has been used herein in lieu of the term "water" because vegetation can be sprinkled with a liquid other than water or with other liquids that are mixed with water.

Additionally, for all embodiments herein, a sprinkler is defined as any device that receives a pressurized liquid input and disperses the liquid in a distributed pattern and a lawn or garden is defined more generically as any area with growing vegetation.

Operation of the First Embodiment

FIG. 1, FIG. 2, FIG. 4, FIG. 5, and FIG. 6

Figure 4:
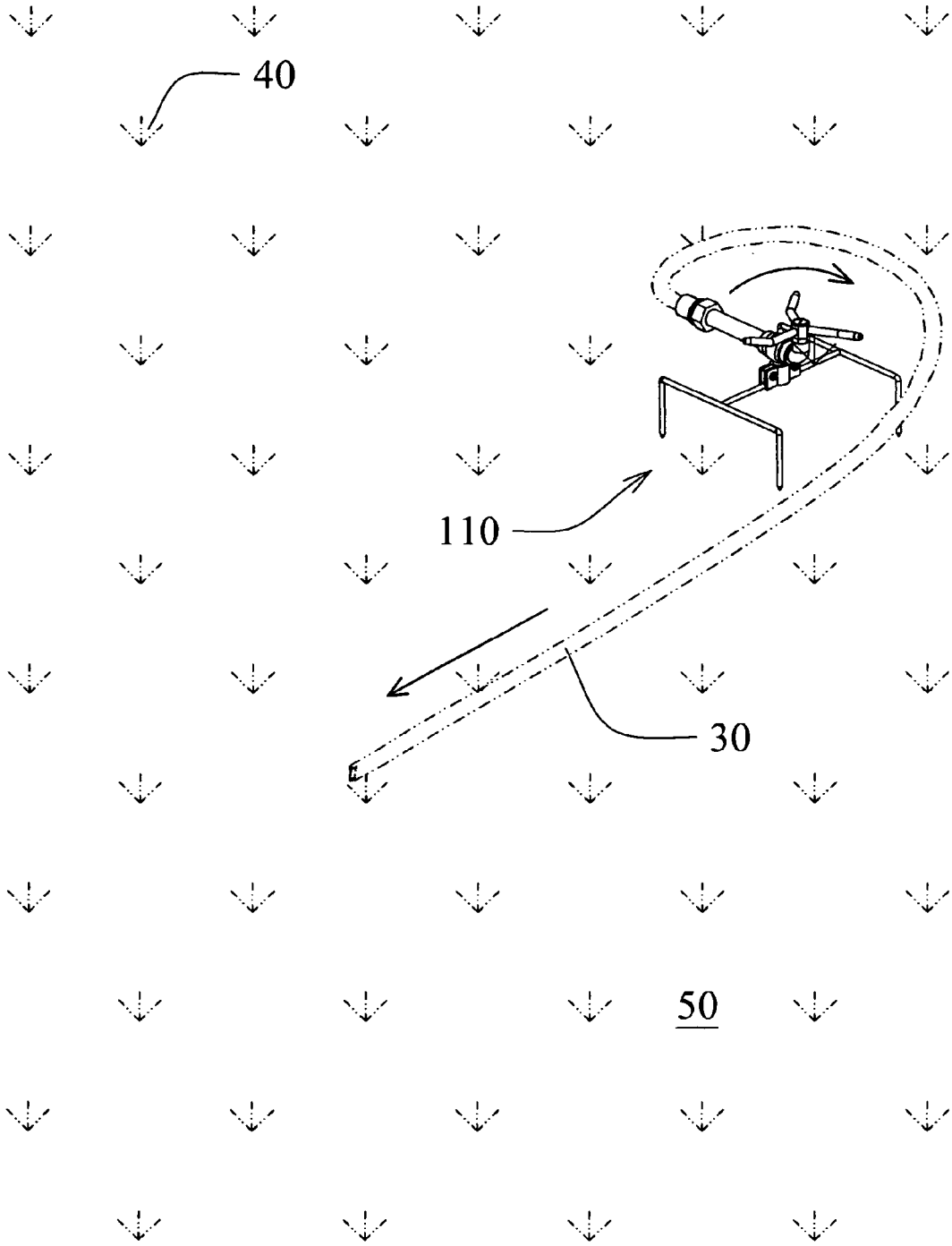
FIG. 4 is a side perspective view showing how pulling a hose connected to the first embodiment will rotate a portion of the first embodiment, thereby, changing pressurized liquid flow to the sprinkler head assembly of the first embodiment from an off state to an on state.

To operate the first embodiment 110 of the disclosed invention, a user rotates the valve support assembly 160 about the valve housing 122 until the valve assembly 120 is off or in an off state and then connects the hose 30 to a faucet and to the inlet connector 128 of the valve assembly 120. Next, the faucet is turned on to pressurize the liquid in the hose 30. The valve support assembly 160 is then placed on a lawn 40 or a ground 50 at a desired location in an orientation such that the hose 30 is partially curved around the valve support assembly 160 as shown in FIG. 4. The leg points 184, 186, 188, and 190 penetrate into the lawn 40 so that the frame 162 engages with the lawn 40; thereby, preventing rotation of the valve support assembly 160. The user then walks away from the first embodiment 110 until out of the sprinkling range. The user then moves or pulls on the hose 30 to move the hose 30 in the direction shown in FIG. 4 which causes the valve housing 122 and the sprinkler head assembly 150 to rotate about the valve support assembly 160 as shown in FIG. 4.

Figure 5:
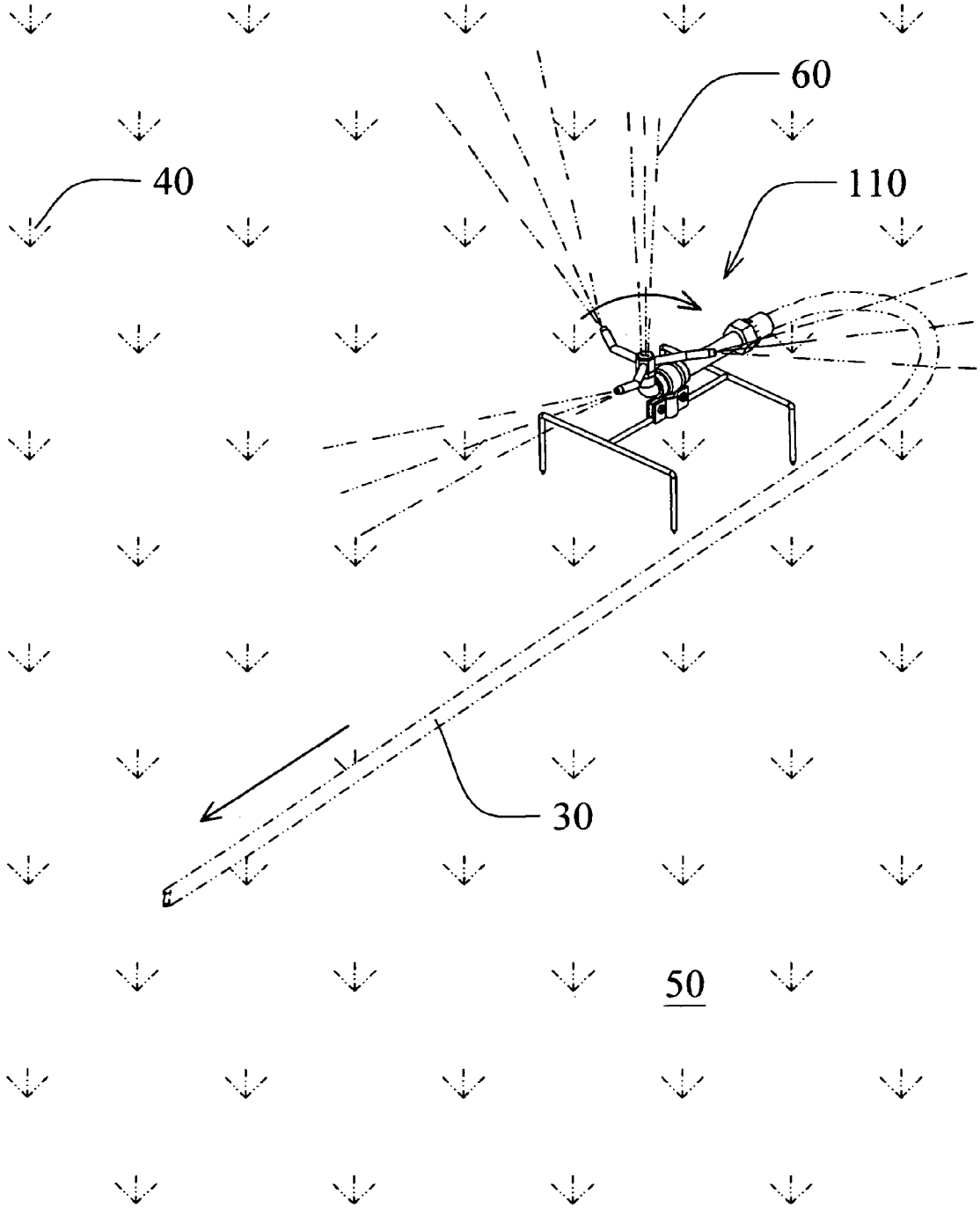
FIG. 5 is a side perspective view showing how a substantially unidirectional pulling of the hose connected to the first embodiment will rotate a portion of the first embodiment, thereby, changing pressurized liquid flow to the sprinkler head assembly of the first embodiment from an on state to an off state.

The hose 30 is pulled until the valve housing 122 and the sprinkler head assembly 150 rotate a total of approximately 90 degrees about the valve support assembly 160 to the orientation shown in FIG. 5, to turn the sprinkler head assembly 150 on or to put the sprinkler head assembly 150 in an on state causing the sprinkler head assembly 150 to output sprinkled liquid 60. The sprinkler head assembly 150 actually begins to turn on when the valve housing 122 has rotated approximately 20 degrees with respect to the valve support assembly 160.

Figure 6:
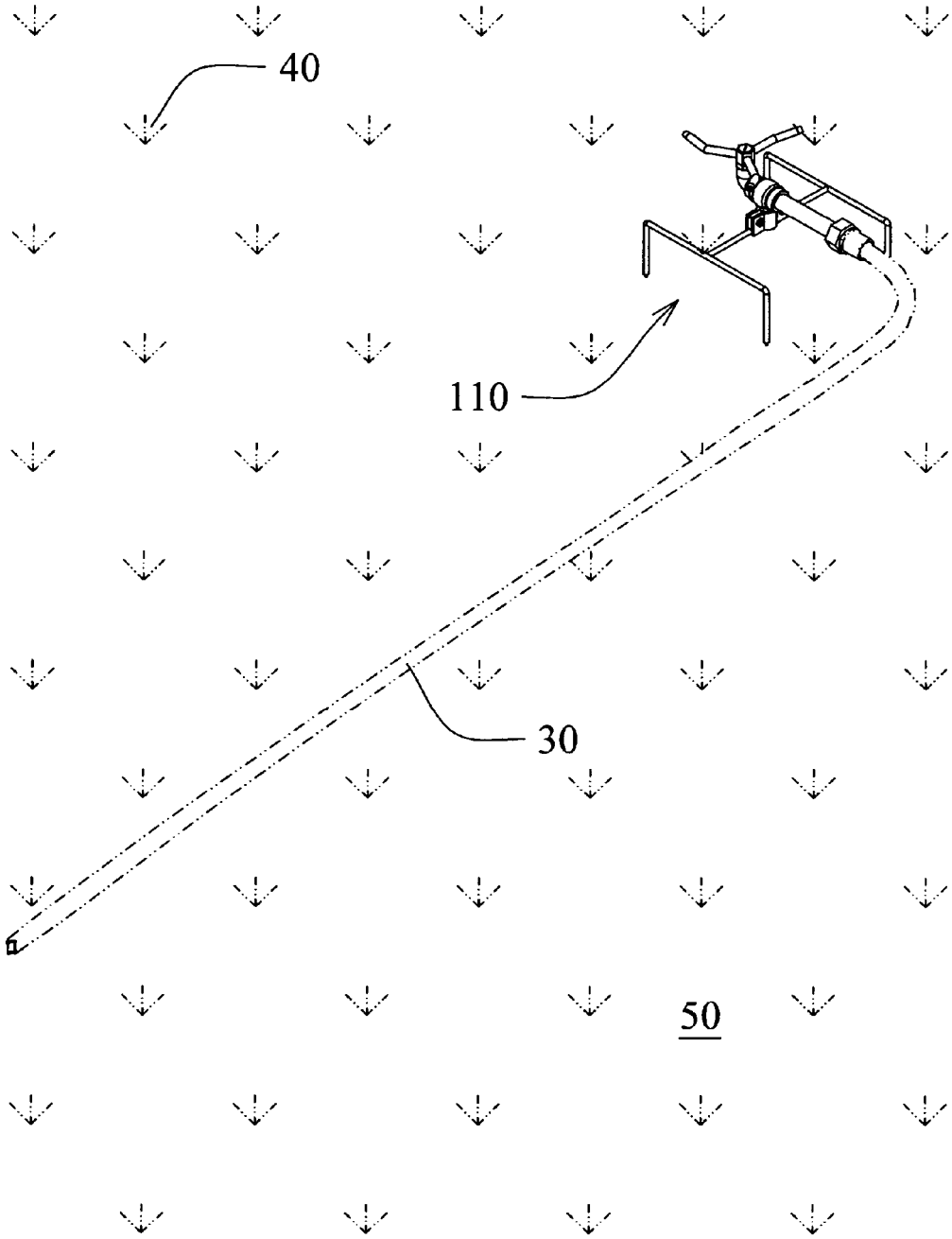
FIG. 6 is a side perspective view showing the first embodiment in an off state.

After the required sprinkling time has elapsed, the user walks to the hose 30 outside of the sprinkling range and again moves or pulls the hose 30 in the same direction as shown in FIG. 5 until the valve housing 122 and the sprinkler head assembly 150 rotate approximately another 90 degrees with respect to the valve support assembly 160 to the orientation shown in FIG. 6, to turn the sprinkler head assembly 150 off or to put the sprinkler head assembly in an off state.

The sprinkler head assembly 150 actually begins to turn off when the valve housing 122 has rotated approximately 20 degrees from the previous on state orientation, as shown in FIG. 5. In the off state, in the on state and in the off state sequence of the sprinkler head assembly 150, the sprinkler head assembly 150 and the valve housing 122 unidirectionally rotate about the valve support assembly 160. The user then walks to the first embodiment 110, picks it up and moves it to the next sprinkling location, again positioning the valve support assembly 160 and the hose 30 in the approximate respective orientation as shown in FIG. 4 and repeats the above procedure by the relocation of the hose controlled sprinkler device and the repetitive pulling of the hose 30 in substantially the same direction, with respect to the hose controlled sprinkler device, to turn the sprinkler head assembly 150 off, on and off, as required.

The sprinkler head assembly 150 turns off, on and off, as described above, in a sequence due to the unidirectional rotation of the valve member 126 rotating in the housing cavity 142 and the subsequent alignment and misalignment of the passageway 144 with respect to the passageway 138. The sprinkler assembly 150 cannot only be controlled to a completely on state, but can also be controlled to intermediate on states by adjusting the distance that the hose 30 is pulled; thereby, adjusting the extent that the valve housing 122 rotates with respect to the rotary member 126. This rotation results in the passageway 138 and the passageway 144 being in a partially discontinuous state or in a partially aligned state with respect to each other, thus restricting the liquid flow through the valve assembly 120 and therefore, the liquid output of the sprinkler assembly 150.

Second Embodiment

FIG. 7

Figure 7:
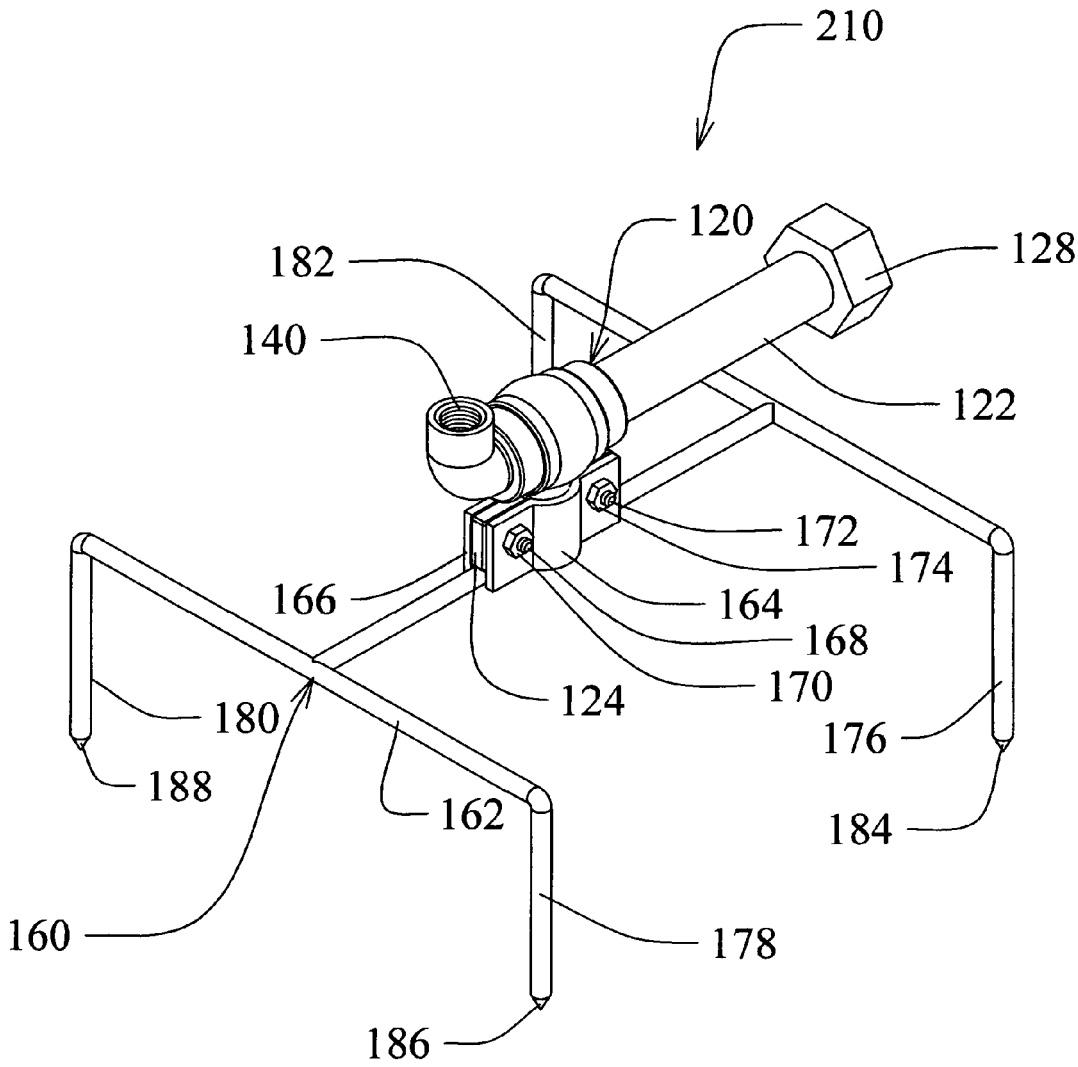
FIG. 7 is a side perspective view showing a second embodiment of the hose controlled sprinkler device.

Referring to FIG. 7, a second embodiment 210 of the hose controlled sprinkler device is shown. The second embodiment 210 includes the valve assembly 120 and the valve support assembly 160 of the first embodiment 110. The valve assembly 120 is connected to the valve support assembly 160 in the same manner as in the first embodiment 110. With the second embodiment 210, a user connects a sprinkler head assembly or sprinkler head such as sprinkler head assembly 150, a rotary sprinkler head, an impulse sprinkler head, a static sprinkler head, etc. to the valve assembly 120 at the outlet connector 140. The outlet connector 140 is shown as a female connector for compatibility with male sprinkler head assembly connector, such as the inlet connector 154, but the outlet connector 140 can also be a male connector for connection with a female sprinkler head assembly connector or any other type of suitable connector, such as any type of threaded connector or quick connector.

Operation of the Second Embodiment

FIG. 4, FIG. 5, FIG. 6, and FIG. 7

The operation of the second embodiment 210 is the same as the operation of the first embodiment 110, with one exception. The exception being that a sprinkler head or a sprinkler head assembly, such as the sprinkler head assembly 150, is first connected to the valve assembly 120 at the outlet connector 140. After this connection has been made, the operation of the second embodiment 210 is the same as with the first embodiment 110.

Third Embodiment

FIG. 8 and FIG. 9

Figure 8:
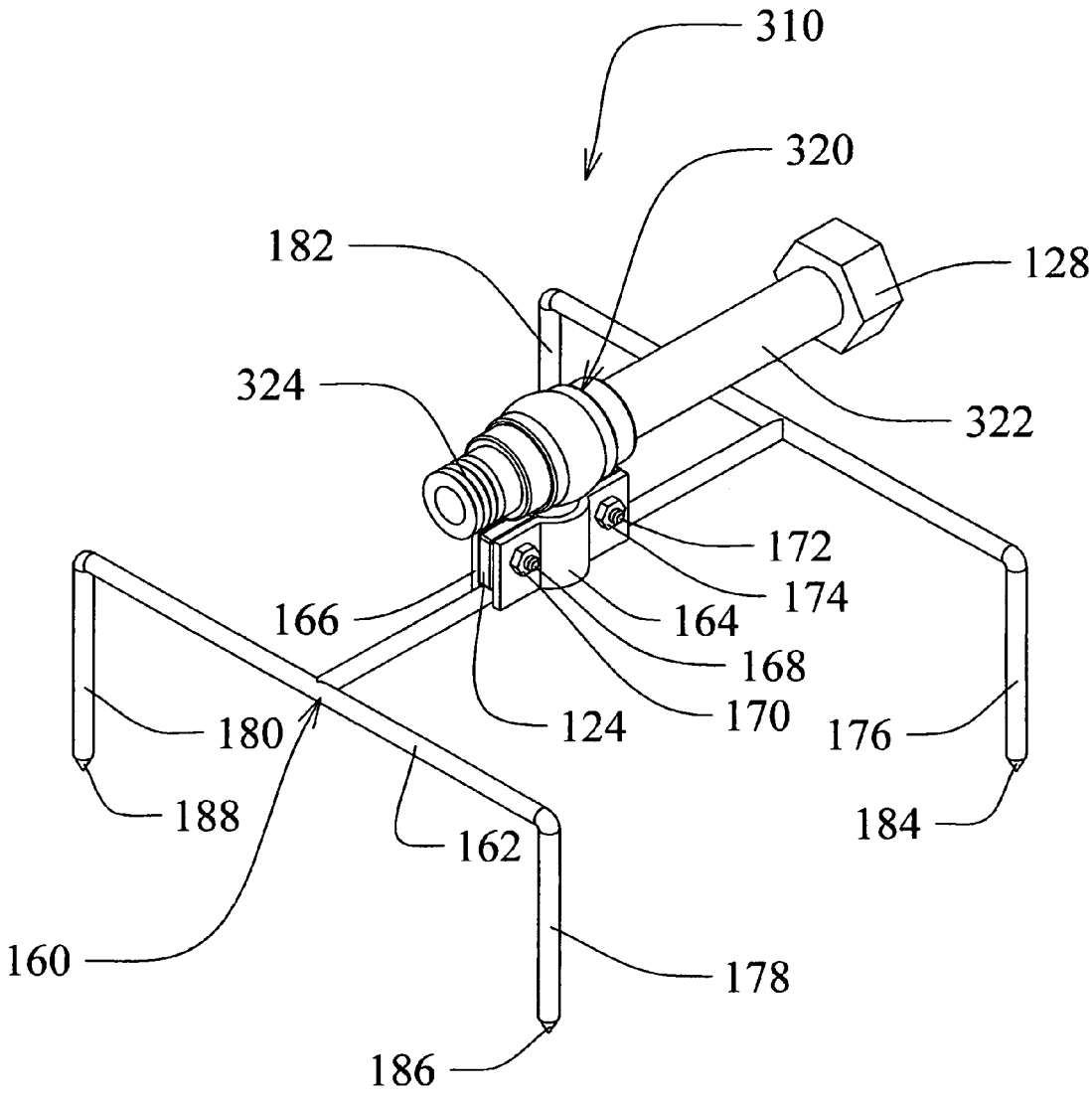
FIG. 8 is a side perspective view showing a third embodiment of the hose controlled sprinkler device.
Figure 9:
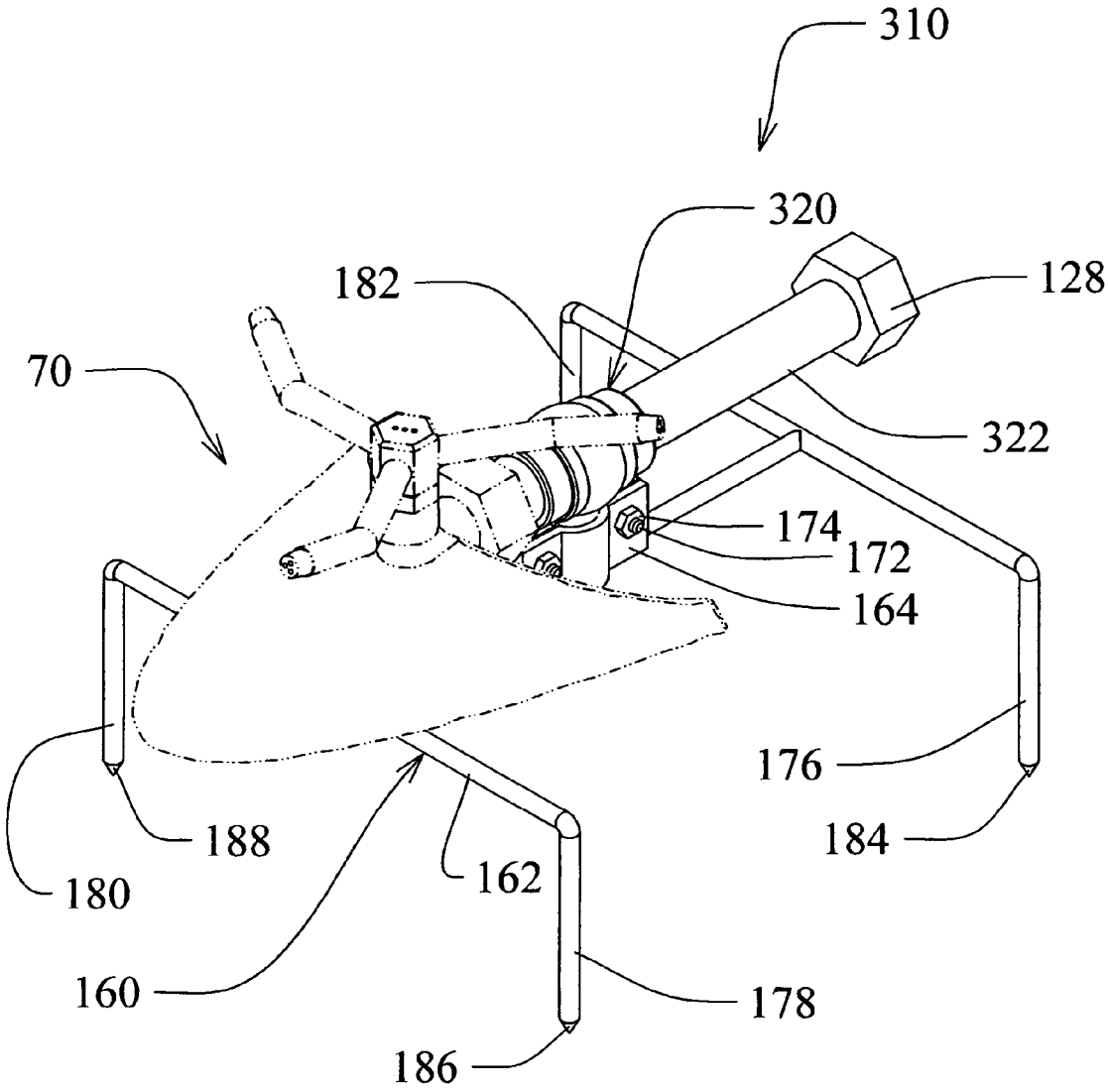
FIG. 9 is a side perspective view showing the third embodiment of the hose controlled sprinkler device connected to a conventional sprinkler.

Referring to FIG. 8 and FIG. 9, a third embodiment 310 of the hose controlled sprinkler device is shown. The third embodiment 310 includes a generic valve, a rotary valve or a rotary valve assembly 320 and the valve support assembly 160. The valve assembly 320 is the same as the valve assembly 120 shown in the first embodiment 110 with the exception that the valve housing 122 has been replaced with a valve housing 322. The valve housing 322 is the same as the valve housing 122 with the exceptions that the outlet connector 140 of the valve housing 122 has been replaced with an outlet port, outlet connection or outlet connector 324 and the valve housing 322 has a different configuration between the outlet connector 324 and the valve cavity 142 then does the same respective area of the valve housing 122. The outlet connector 324 is configured to connect to all conventional sprinkler inlet connectors.

With the third embodiment 310, a user connects a conventional sprinkler 70 to the outlet connector 324, as shown in FIG. 9. The conventional sprinkler 70 can be any type of sprinkler such as a rotary sprinkler, an impulse or impact sprinkler, a static sprinkler, an oscillating sprinkler, etc. The valve assembly 320 is connected to the valve support assembly 160 in the same manner as with the first embodiment 110. As with the first embodiment 110, the conventional sprinkler 70 is more generically defined as a sprinkler.

Operation of the Third Embodiment

FIG. 4, FIG. 5, FIG. 6, FIG. 8 and FIG. 9

The operation of the third embodiment 310 is the same as the operation of the first embodiment 110, with one exception. The exception being that the sprinkler 70 is first connected to the valve assembly 320 at the outlet connector 324. After this connection has been made, the operation of the third embodiment 310 is the same as with the first embodiment 110.

Fourth Embodiment

FIG. 10

Figure 10:
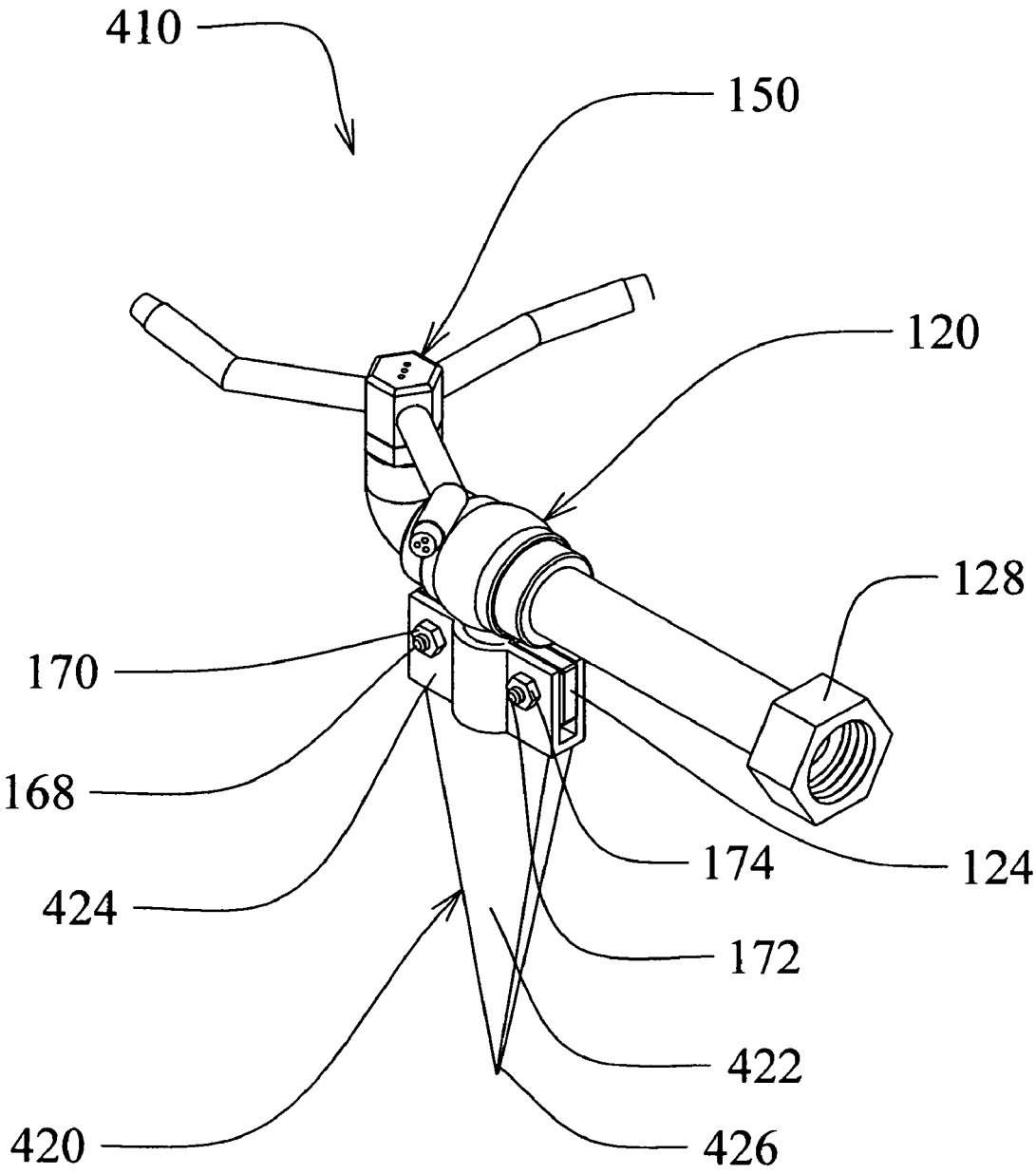
FIG. 10 is a side perspective view showing a fourth embodiment of the hose controlled sprinkler device.

Referring to FIG. 10, a fourth embodiment 410 of the hose controlled sprinkler device is shown. The fourth embodiment 410 includes the generic valve, the rotary valve or the rotary valve assembly 120, the sprinkler head or the sprinkler head assembly 150, and a valve support assembly 420. The valve support assembly 420 includes a ground penetrating single support 422, the screw 168, the nut 170, the screw 172 and the nut 174. The single support 422 is attached to a connection bracket 424 and has a point 426. The single support 422 is assembled to the valve handle 124 by placing the valve handle 124 in association with the connection bracket 424, as shown in FIG. 10, and securing the valve handle 124 to the connection bracket 424 with the screw 168, the nut 170, the screw 172 and the nut 174. The sprinkler head assembly 150 is connected to the rotary valve assembly 120 in the same manner as in the first embodiment 110. The purpose of the point 426 is to reduce the force required for penetration of the single support 422 into the ground 50.

Operation of the Fourth Embodiment

FIG. 4, FIG. 5, FIG. 6, and FIG. 10

The operation of the fourth embodiment 410 is the same as with the first embodiment 110 except that instead of placing the fourth embodiment 410 on the lawn 40, as with the first embodiment 110, the single support 422 is pushed into the ground 50 by the operator to stabilize the fourth embodiment 410 with respect to the ground 50.

Fifth Embodiment

FIG. 11

Figure 11:
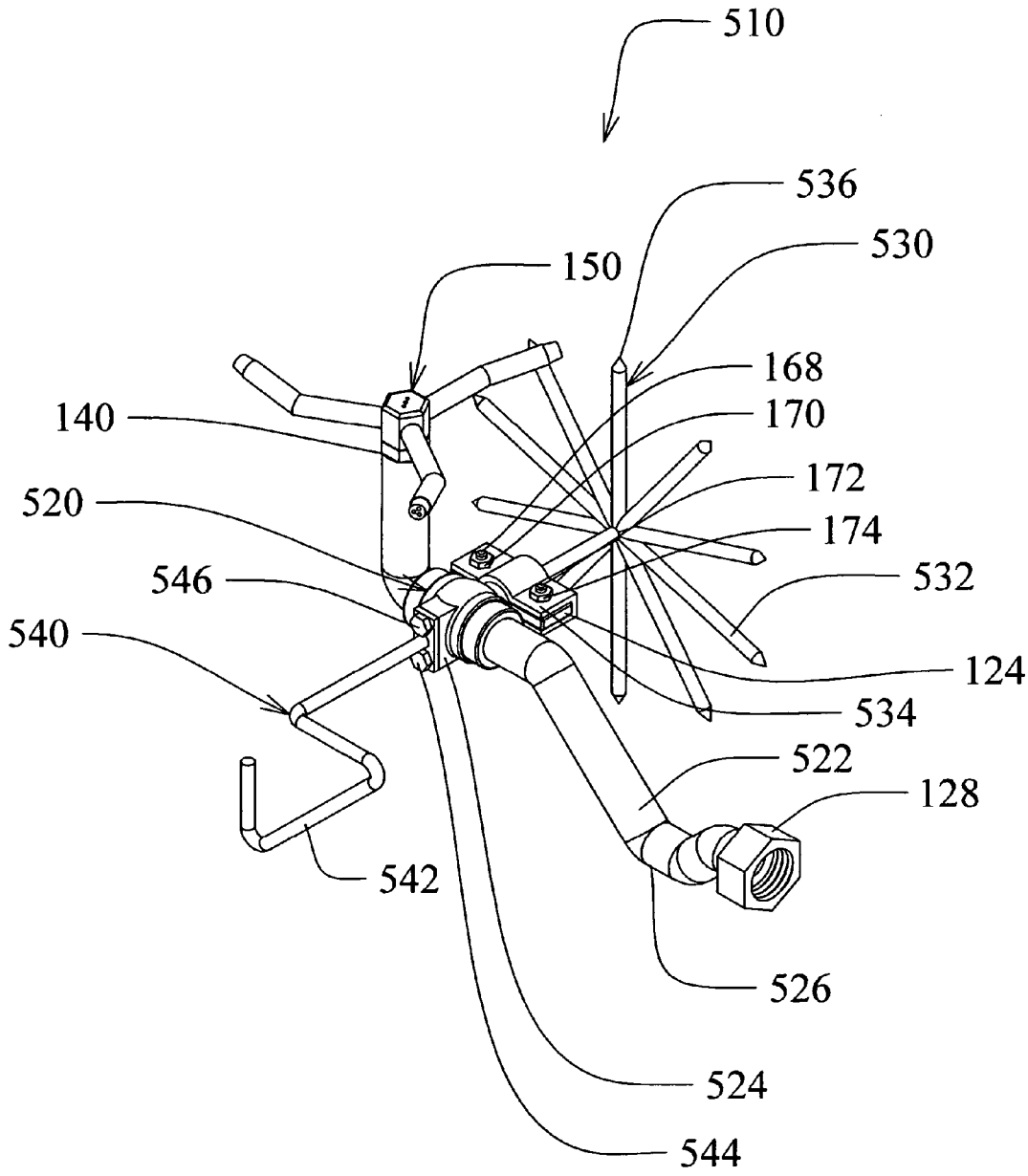
FIG. 11 is a side perspective view showing a fifth embodiment of the hose controlled sprinkler device.

Referring to FIG. 11, a fifth embodiment 510 of the hose controlled sprinkler device is shown. The fifth embodiment 510 includes a generic valve, a rotary valve or a rotary valve assembly 520, a wheel configured valve support assembly or a rotary valve support assembly 530, a side valve support assembly 540 and the sprinkler head or the sprinkler head assembly 150. The rotary valve assembly 520 is the same as the rotary valve assembly 120 except that the valve housing 122 has been replaced with a valve housing 522. The valve housing 522 is the same as the valve housing 122 with 2 exceptions, namely (1) the valve housing 522 has different configurations between the inlet connector 128 and the housing cavity 142 and between the outlet connector 140 and the housing cavity 142 and (2) the valve housing 522 has a mounting boss 524 that the valve housing 122 does not have.

The rotary valve support assembly 530 includes a wheel configured valve support or a rotary valve support 532, a connection bracket 534, the screw 168, the nut 170, the screw 172 and the nut 174.

The side valve support assembly 540 includes a side valve support 542, a bolt 544 and a bolt 546. The rotary valve support 532 is attached to the connection bracket 534. The rotary valve support 532 is assembled to the valve handle 124 by placing the valve handle 124 in association with the connection bracket 534, as shown in FIG. 11, and securing the valve handle 124 to the connection bracket 534 with the screw 168, the nut 170, the screw 172 and the nut 174. The side valve support 542 is connected to the mounting boss 524 using the bolt 544 and the bolt 546.

The sprinkler head assembly 150 is connected to the valve housing 522 by screwing the inlet connector 154 into the outlet connector 140. The rotary valve support 532 has a plurality of points 536 to assist the rotary valve support 532 to penetrate and engage with the associated lawn 40 or the ground 50 upon placement of the fifth embodiment 510 on the lawn 40 or the ground 50. The fifth embodiment 510 has 3 valve supports, as shown in FIG. 11, namely, the rotary valve support 532, the side valve support 542 and the valve housing 522, at a valve housing location 526 but can have only two valve supports as explained in the CONCLUSION, RAMIFICATIONS, AND SCOPE section, below.

Operation of the Fifth Embodiment

FIG. 11, FIG. 12, FIG. 13, and FIG. 14

Figure 12:
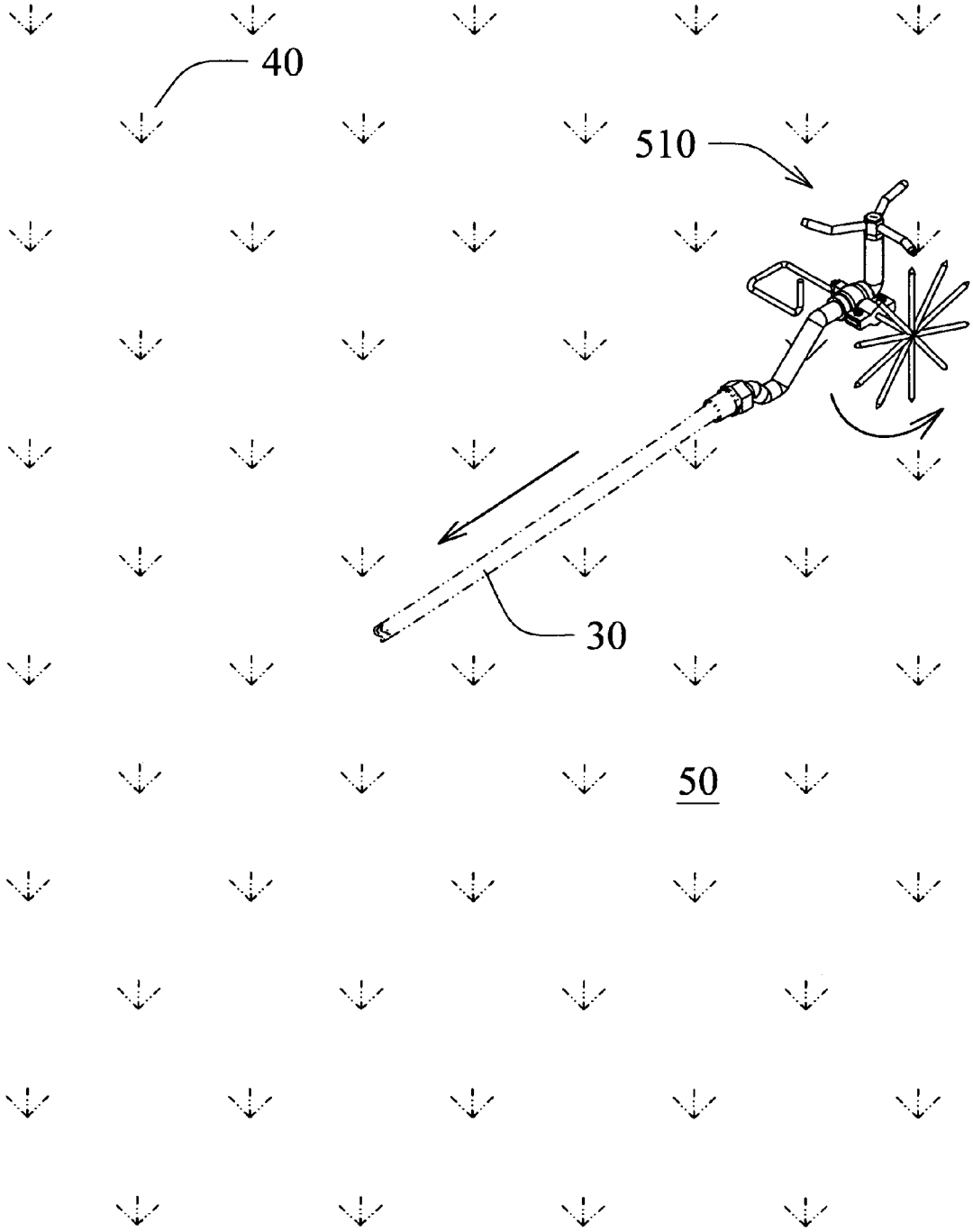
FIG. 12 is a side perspective view showing how pulling a hose connected to the fifth embodiment will rotate a portion of the fifth embodiment, thereby, changing pressurized liquid flow to a sprinkler head assembly of the fifth embodiment from an off state to an on state.

To operate the fifth embodiment 510 of the disclosed invention, the rotary valve support assembly 530 is rotated about the valve housing 522 until the valve assembly 520 is off or in an off state and then the supply hose 30 is connected to a faucet and then connected to the inlet connector 128 of the valve assembly 520. Next, the faucet is turned on to pressurize the liquid in the supply hose 30. The fifth embodiment 510 is then placed on the lawn 40 or on the ground 50 at a desired location, as shown in FIG. 12. The user then walks away from the fifth embodiment 510 until out of the sprinkling range. The user then moves or pulls on the hose 30 to move the hose 30 in the direction shown in FIG. 12 which causes the rotary valve support assembly 530 to rotate in the direction, as shown in FIG. 12, due to the engagement of the rotary valve support assembly 530 with the lawn 40.

The rotation of the rotary valve support assembly 530 causes the rotary valve member 126 of the valve assembly 520 to rotate with respect to the valve housing 522. The hose 30 is pulled until the rotary valve member 126 has rotated approximately 90 degrees with respect to the valve housing 522 to turn the sprinkler head assembly 150 on or to put the sprinkler head assembly 150 in an on state causing sprinkled liquid 60 to be output from the sprinkler head assembly 150, as shown in FIG. 13.

Figure 13:
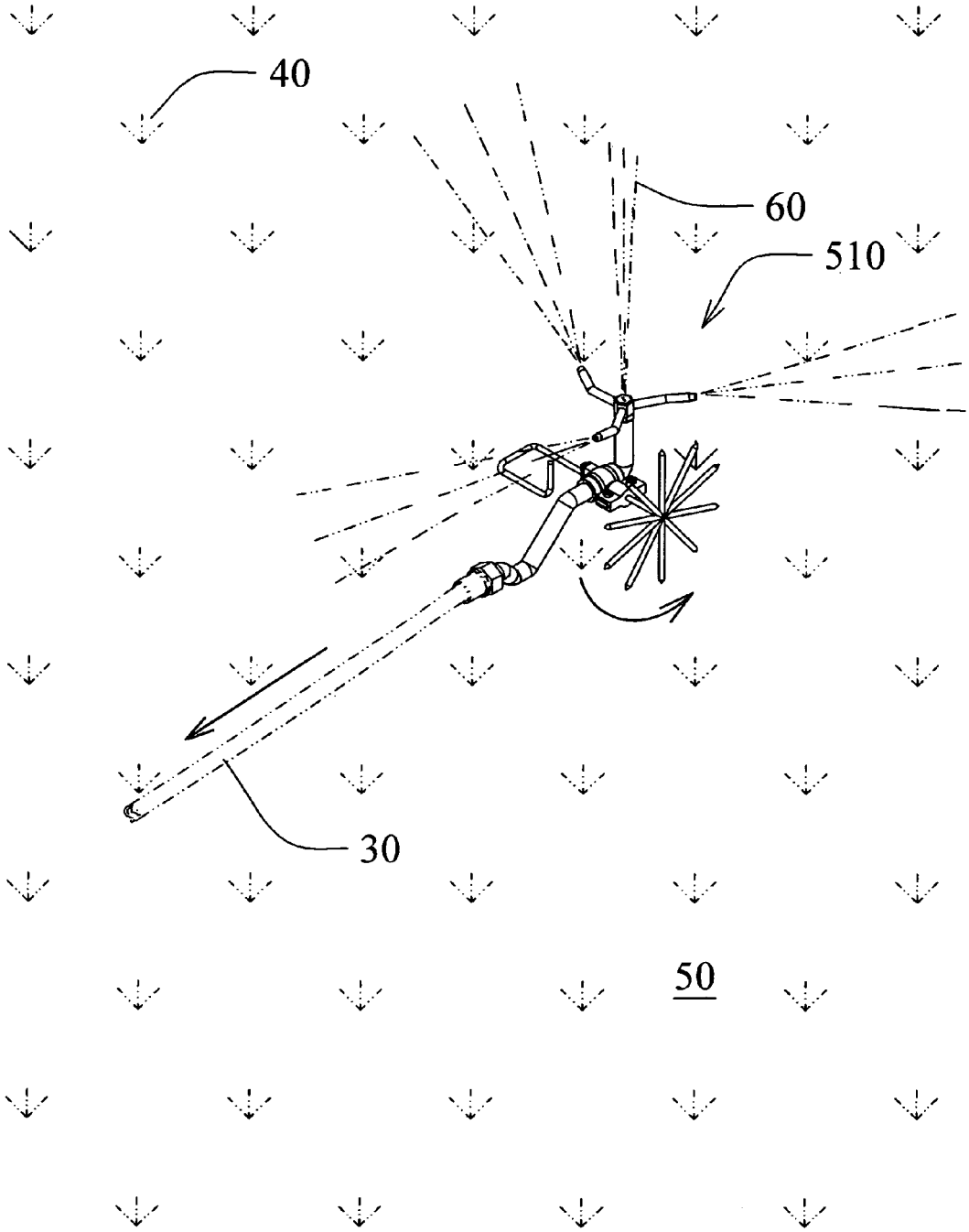
FIG. 13 is a side perspective view showing how the substantially unidirectional pulling of the hose connected to the fifth embodiment will rotate a portion of the fifth embodiment, thereby, changing pressurized liquid flow to the sprinkler head assembly of the fifth embodiment from an on state to an off state.
Figure 14:
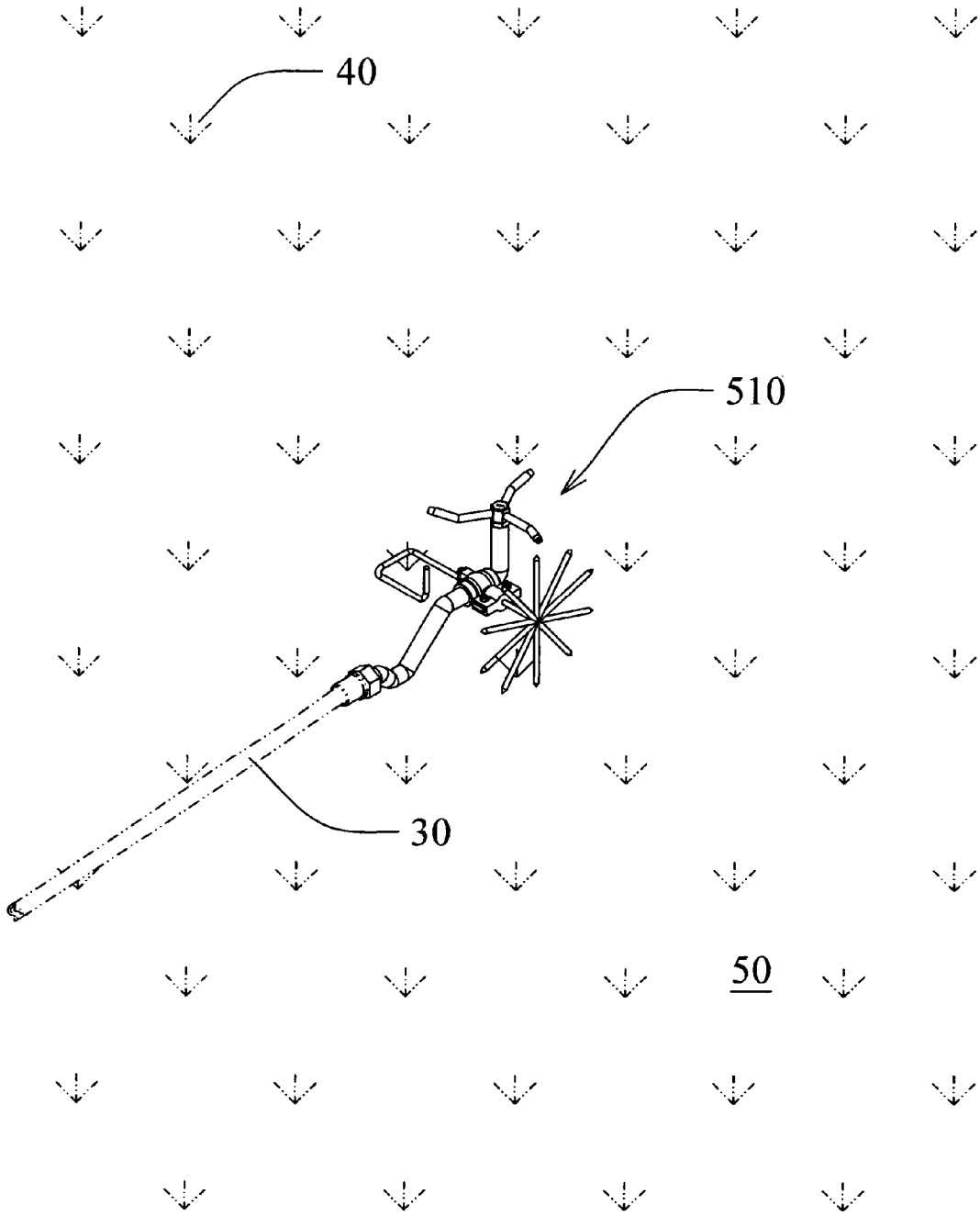
FIG. 14 is a side perspective view showing the fifth embodiment in an off state.

After the required sprinkling time has elapsed, the user walks to the supply hose 30 outside of the sprinkling range and again moves or pulls the hose 30 in the same direction as shown in FIG. 13 until the rotary valve member 126 has rotated approximately another 90 degrees with respect to the valve housing 522 to turn the sprinkler head assembly 150 off or to put the sprinkler head assembly 150 in an off state, as shown in FIG. 14. The user then walks to the fifth embodiment 510, picks it up and moves it to the next sprinkling location and repeats the above procedure by the relocation of the hose controlled sprinkler device and the repetitive pulling of the supply hose 30, in substantially the same direction, with respect to the hose controlled sprinkler device, to turn the sprinkler head assembly 150 off, on and off, as required.

As with the first embodiment 110, the fifth embodiment 510 has the same off state, on state, off state sequence established by the rotary valve support assembly 530 rotating about the valve housing 522, which in turn, causes the rotary valve member 126 to rotate about the housing cavity 142 and the subsequent alignment and misalignment of the passageway 144 with respect to the passageway 138. Also, as with the first embodiment 110, the sprinkler head assembly 150 cannot only be controlled to a completely on state, but to an intermediate on state by adjusting the distance that the hose is pulled; thereby, adjusting the degree of alignment between the passageway 138 and the passageway 144 and the subsequent reduction of sprinkled liquid 60 output from the sprinkler assembly 150.

Sixth Embodiment

FIG. 15

Figure 15:
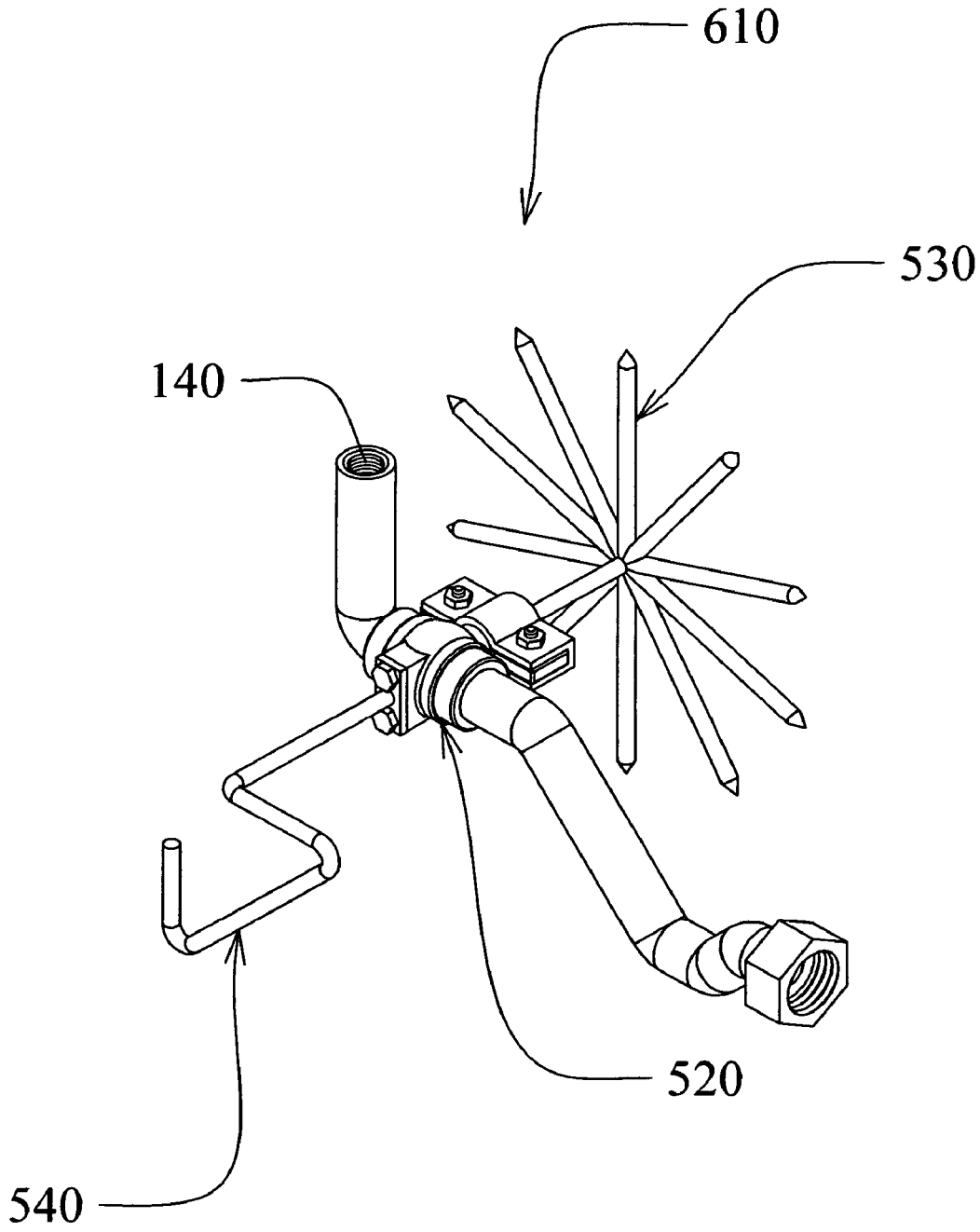
FIG. 15 is a side perspective view showing a sixth embodiment of the hose controlled sprinkler device.

Referring to FIG. 15, a sixth embodiment 610 of the hose controlled sprinkler device is shown. The sixth embodiment 610 includes the rotary valve or the rotary valve assembly 520, the wheel configured valve support assembly or the rotary valve support assembly 530 and the side valve support assembly 540 of the fifth embodiment 510. The rotary valve assembly 520, the rotary valve support assembly 530 and the side valve support assembly 540 are connected to each other in the same manner as in the fifth embodiment 510. As with the second embodiment 210, a user connects a sprinkler head assembly or a sprinkler head such as the sprinkler head assembly 150, a rotary sprinkler head, an impulse sprinkler head, a static sprinkler head, etc. to the valve assembly 520 at the outlet connector 140.

Operation of the Sixth Embodiment

FIG. 12, FIG. 13, FIG. 14, and FIG. 15

The operation of the sixth embodiment 610 is the same as the operation of the fifth embodiment 510, with one exception. The exception being that a conventional sprinkler head assembly, such as the sprinkler head assembly 150, is first connected to the valve assembly 520 at the outlet connector 140. After this connection has been made, the operation of the sixth embodiment 610 is the same as with the fifth embodiment 510.

Seventh Embodiment

Figure 16:
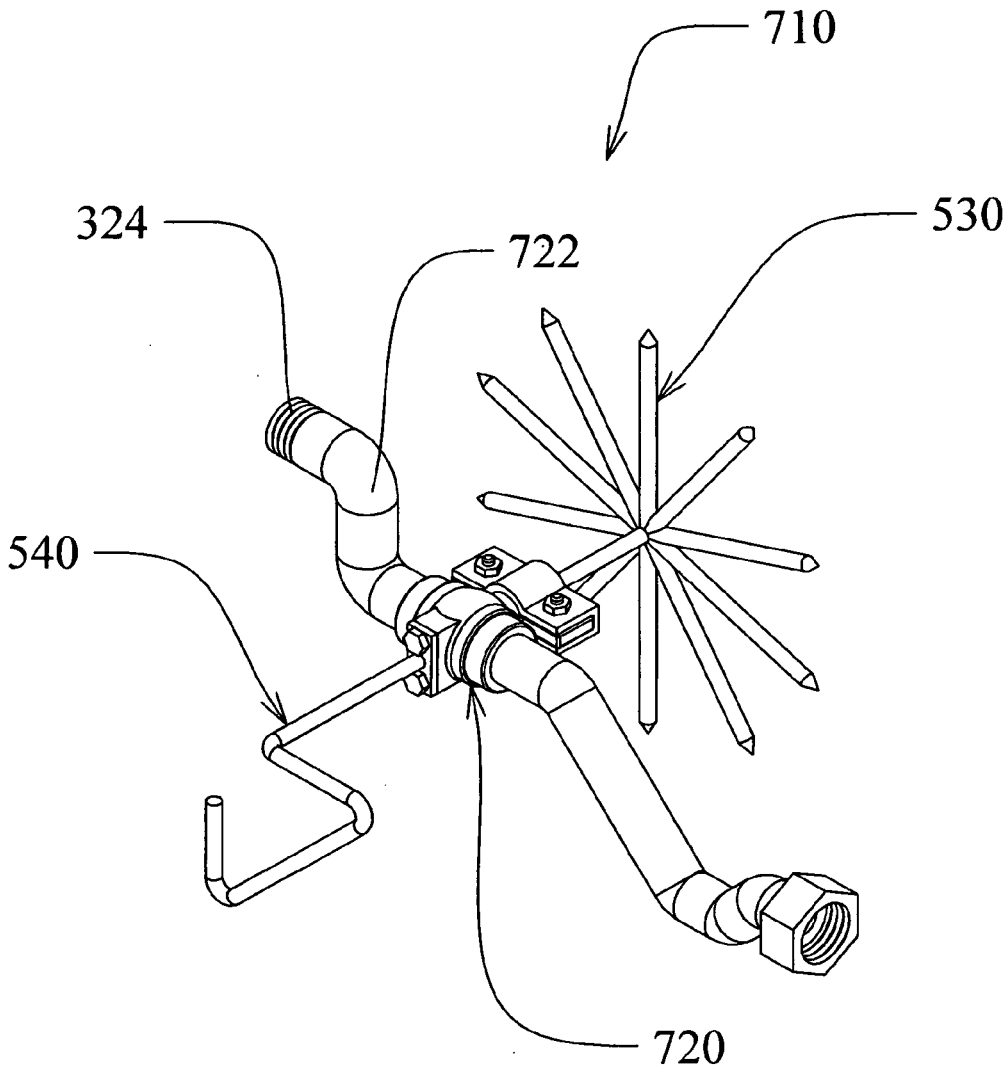
FIG. 16 is a side perspective view showing a seventh embodiment of the hose controlled sprinkler device.
Figure 17:
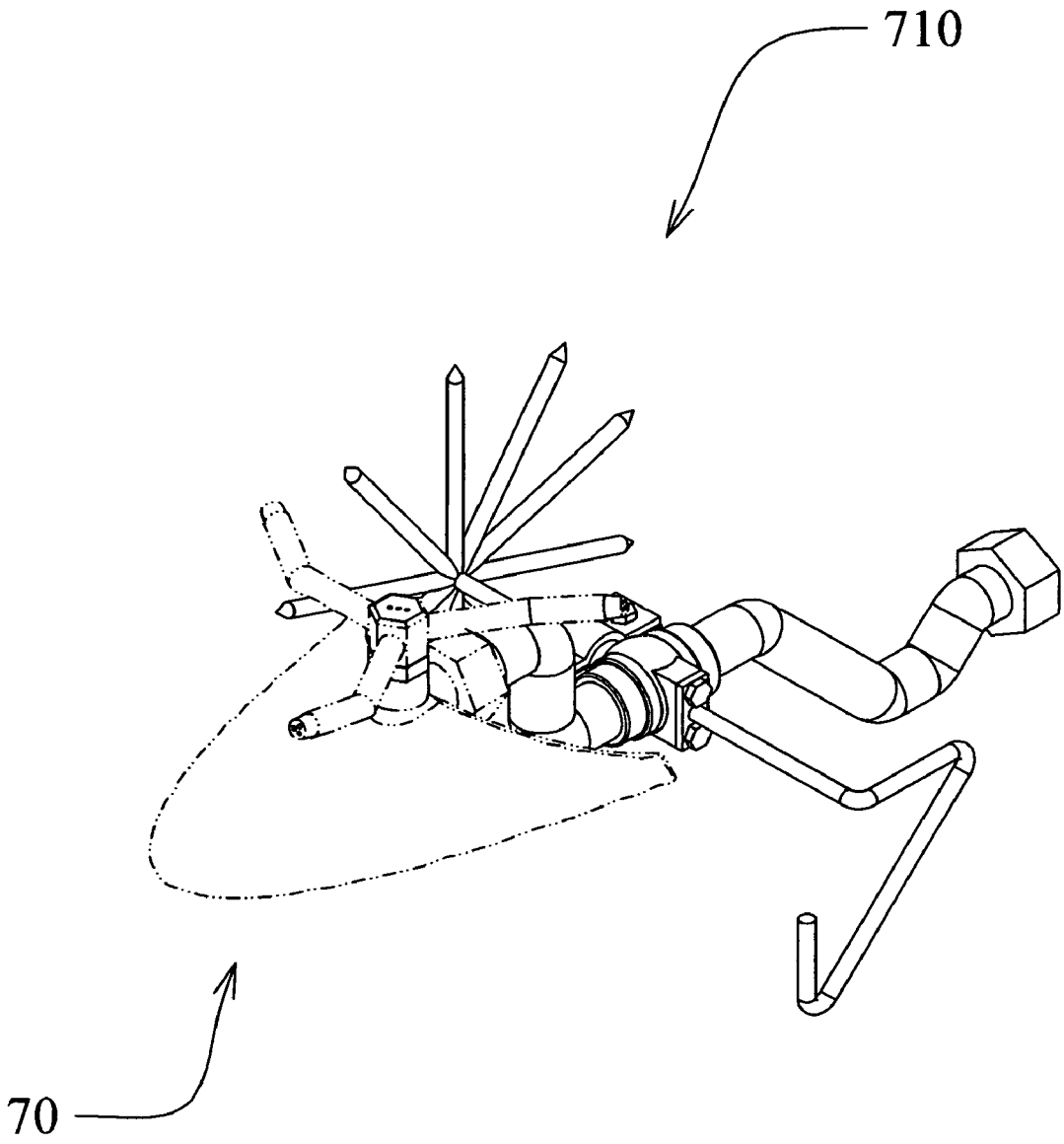
FIG. 17 is a side perspective view showing the seventh embodiment of the hose controlled sprinkler device connected to the conventional sprinkler.

FIG. 16 and FIG. 17

Referring to FIG. 16 and FIG. 17, a seventh embodiment 710 of the hose controlled sprinkler device is shown. The seventh embodiment 710 includes a generic valve, a rotary valve or a rotary valve assembly 720, the wheel configured valve support assembly or the rotary valve support assembly 530 and the side valve support assembly 540. The valve assembly 720 is the same as the valve assembly 520 with the exception that the valve housing 522 has been replaced with a valve housing 722. The valve housing 722 is the same as the valve housing 522 with the exceptions that the outlet connector 140 of the valve housing 522 has been replaced with the outlet connector 324 and the valve housing 722 has a different configuration between the outlet connector 324 and the valve cavity 142 then does the same respective area of the valve housing 522.

The rotary valve assembly 720, the rotary valve support assembly 530 and the side valve support assembly 540 are connected to each other in the same manner as in the fifth embodiment 510. With the seventh embodiment 710, a user connects the conventional sprinkler 70 to the outlet connector 324, as shown in FIG. 17. The conventional sprinkler 70 can be any type of conventional sprinkler such as a rotary sprinkler, an impulse or impact sprinkler, a static sprinkler, an oscillating sprinkler, etc. As with the first embodiment 110, that the conventional sprinkler 70 is defined more generically as a sprinkler.

Operation of the Seventh Embodiment

FIG. 12, FIG. 13, FIG. 14, FIG. 16, and FIG. 17

The operation of the seventh embodiment 710 is the same as the operation of the fifth embodiment 510, with one exception. The exception being that the conventional sprinkler 70 is first connected to the valve assembly 720 at the outlet connector 324. After this connection has been made, the operation of the seventh embodiment 710 is the same as with the fifth embodiment 510.

Eighth Embodiment

FIG. 7, FIG. 8, FIG. 9, FIG. 15, FIG. 16, and FIG. 17

In the eighth embodiment, the hose controlled sprinkler device is alternately defined and configured as an on-off valve control system for placement between a sprinkler 70 or a sprinkler head assembly 150 and a sprinkler supply hose 30. The on-off valve control system includes a valve assembly and a valve support assembly. The valve assembly is selected from a group including the rotary valve assembly 120, the rotary valve assembly 320, the rotary valve assembly 520 and the rotary valve assembly 720. The valve support assembly is selected from a group including the valve support assembly 160, the valve support assembly 420 and the valve support assembly 530. The valve support assembly is connected to the rotary valve member 126 of the valve assembly in the same manner as with the second embodiment 210, the third embodiment 310, the sixth embodiment 610 and the seventh embodiment 710. The supply hose 30 is connected to the inlet connector 128 of the valve assembly and either the sprinkler head assembly 150 or the sprinkler 70 is connected to the outlet connector 140 or the outlet connector 324, respectively.

Operation of the Eighth Embodiment

FIG. 4, FIG. 5, FIG. 6, FIG. 12, FIG. 13, and FIG. 14

The operation of the eighth embodiment is the same as with the operation of the second embodiment 210, the third embodiment 310, the sixth embodiment 610 and the seventh embodiment 710, as applicable.

Ninth Embodiment

FIG. 1, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, and FIG. 17

Also disclosed herein is a method for remotely controlling the output states of the supply hose 30 pressurized with a liquid including the steps of: providing the hose controlled sprinkler device, the sprinkler device including: a valve assembly selected from the group including the rotary valve assembly 120, the rotary valve assembly 320, the rotary valve assembly 520 and the rotary valve assembly 720 and a valve support assembly selected from the group including the valve support assembly 160, the valve support assembly 420 and the valve support assembly 530, the valve support assembly being connected to the rotary member 126 of the valve assembly; providing the hose 30 and the liquid; connecting the hose 30 to the inlet connector 128 of the valve assembly; pressurizing the supply hose 30 with the liquid; moving the supply hose 30 to enable the off state of the valve assembly; moving the supply hose 30 in substantially the same direction to enable the on state of the valve assembly; and moving the supply hose 30 again in substantially the same direction to enable the off state of the valve assembly, whereby the output states of the supply hose 30 can be remotely controlled in a liquid off state, a liquid on state and a liquid off state sequence by the substantially unidirectional movement of the supply hose 30.

ADVANTAGES OF THE EMBODIMENTS

From the descriptions above, a number of advantages of my hose controlled sprinkler device and control method therefor become evident.

(a) The sprinkler device can be remotely turned on and off in an off state, an on state and an off sequence by the simple substantially unidirectional pulling of a sprinkler device connected supply hose.

(b) The sprinkler device can remotely turn on and off a sprinkler, connected to the sprinkler device, outside of its sprinkling range in an off state, an on state and an off state sequence by the simple substantially unidirectional pulling of a sprinkler device connected supply hose.

(c) The method provides for remote output control of a hose, pressurized with a liquid, in a liquid off state, a liquid on state and a liquid off state sequence by the simple substantially unidirectional pulling of the hose.

(d) The method provides for remote output control of a sprinkler, connected to the sprinkler device, in an off state, an on state and an off state sequence by the simple substantially unidirectional pulling of a supply hose connected to the sprinkler device.

(e) The sprinkler device can be remotely adjusted to a partially on state by simply pulling on a sprinkler device connected supply hose.

(f) The sprinkler device can remotely adjust the output of a sprinkler, connected to the sprinkler device, outside of its sprinkling range to a partially on state by the simple substantially unidirectional pulling of a sprinkler device connected supply hose.

(g) The sprinkler device and method significantly reduce walking when changing sprinkling locations.

(h) The sprinkler device and method significantly reduce dragging of a supply hose when changing sprinkling locations.

(i) The sprinkler device and method significantly reduce the time required for changing sprinkling locations.

(j) The sprinkler device has only one moving part when not associated with a sprinkler.

(k) The sprinkler device can connect to conventional sprinklers.

(l) The sprinkler device can connect to conventional sprinkler heads.

(m) The sprinkler device and method do not require manual pushing of the device into the ground, with the exception of the fourth embodiment.

(n) The sprinkler device has a high resistance to malfunction due to its low part count.

(o) The sprinkler device is simple in design and therefore, inexpensive.

(p) The sprinkler device and method are simple-to-use.

(q) The sprinkler device and method are user friendly.

(r) The sprinkler device is reliable, due to its simple design.

CONCLUSION, RAMIFICATIONS, AND SCOPE

Thus, a person of ordinary skill in the art will understand that the hose controlled sprinkler device and method therefor is novel, simple, user friendly, inexpensive, as well as reliable and has many advantages, features, and benefits over the prior art. Furthermore, it will be readily apparent to one skilled in the art that the hose controlled sprinkler device and method therefor of this application are essential for significantly reducing the labor, effort, and time involved in sprinkling lawns. In addition, it should be evident that the simple design of the hose controlled sprinkler device, that permits its output to be remotely controlled in an off state, an on state and an off state sequence by the mere substantially unidirectional pulling of a device connected supply hose, is truly unique. Moreover, the hose controlled sprinkler device and method therefor may have one or more of the following additional advantages.

The sprinkler device has only one moving part, when not associated with a sprinkler, which significantly reduces the cost and likelihood of failure.

The sprinkler device can be remotely adjusted to a partially on state by simply pulling the sprinkler device connected supply hose.

The sprinkler device can connect to conventional sprinklers;

The sprinkler device can connect to conventional sprinkler head assemblies or sprinkler heads.

The sprinkler device and method do not require manual pushing of the device into the ground, with the exception of the fourth embodiment.

The sprinkler device and method are user friendly and simple-to-use.

The sprinkler device and method significantly reduce the chance of getting the user wet when changing sprinkling locations.

While the above description contains many specifics, these specifics should not be construed as limitations on the scope of the disclosed invention, but rather as an exemplification of several preferred embodiments thereof.

Many other ramifications, variations, alterations, substitutions, modifications, and the like are readily possible. For example, sizes, shapes, materials, assembly, design, etc. of all parts can be readily modified or changed.

The outlet connector 140 of the valve assembly 120 of the first embodiment 110, the second embodiment 210 and the fourth embodiment 410 and the valve assembly 520 of the fifth embodiment 510 and the sixth embodiment 610 can be of any type, such as male, female, threaded, non-threaded, press fit, quick, clamped connector or connection or integrated directly into the inlet connector 154 itself so that sprinklers or sprinkler head assemblies with any type of connector can used with the first embodiment 110, the second embodiment 210, the fourth embodiment 410, the fifth embodiment 510 and the sixth embodiment 610.

The outlet connector 324 of the valve assembly 320 of the third embodiment 310 and the valve assembly 720 of the seventh embodiment 710 can be of any type such as male, female, threaded, non-threaded, quick connector, etc. so that sprinklers with any type of connector can be used with the third embodiment 310 and the seventh embodiment 710.

The frame 162 can have more or less that 4 valve supports or frame legs.

The frame 162 can be replaced with a single base with a foot print large enough to stabilize the valve assemblies 120 and 320 above the lawn 40 and the ground 50 and will engage with the lawn 40 and the ground 50.

The sprinkler head assembly 150 of the first embodiment 110, the fourth embodiment 410 and the fifth embodiment 510 can be replaced with any type of sprinkler head assembly such as another type of rotary sprinkler head, an impact or an impulse sprinkler head, a static sprinkler head, an oscillating sprinkler head etc.

Simple rollers can be placed on the frame legs 176, 178, 180 and 182 to reduce the friction in the event that the sprinkler device connected, supply hose 30 touches any of the frame legs 176, 178, 180 and 182 while the supply hose 30 is being pulled.

The frame legs 176, 178, 180 and 182, can be coated with a low friction material to reduce friction to a minimum in the event that the sprinkler device connected supply hose 30 touches any of the frame legs 176, 178, 180, and 182 while the supply hose 30 is being pulled.

The valve housing 122 and valve housing 322 can include a hose strain relief or a bend restrictor to limit the supply hose 30 to a more controlled bend when the supply hose 30 is being pulled; thereby, preventing the supply hose 30 from contacting any of the frame legs 176, 178, 180 and 182.

The valve housing 122, the outlet connector 140 and the inlet connector 128 can be made as a single or one piece unit.

The inlet connector 154 can be any type of connector or connection.

The valve housing 322, the outlet connector 324 and the inlet connector 128 can be made as a single or one piece unit.

The valve housing 522, the outlet connector 140, the inlet connector 128 and the side valve support assembly 540 can be made as a single or one piece unit.

The valve housing 722, the outlet connector 324, the inlet connector 128 and the side valve support assembly 540 can be made as a single or one piece unit.

The rotary valve handle 124, the rotary valve member 126 and/or the valve support assembly 160 can be made as a single or one piece unit.

The rotary valve handle 124, the rotary valve member 126 and/or the valve support assembly 420 can be made as a single or one piece unit.

The rotary valve handle 124, the rotary valve member 126 and/or the rotary valve support assembly 530 can be made as a single or one piece unit.

The valve assembly 120 can be sealed, ported and configured so that the outlet connector 140 is connected directly to the rotary valve member 126, opposite from handle 124; thereby, enabling the outlet connector 140 to remain stationary when the output states of the first embodiment 110, the second embodiment 210 and the fourth embodiment 410 are changed.

The valve assembly 320 can be sealed, ported and configured so that the outlet connector 324 is connected directly to the rotary valve member 126, opposite from handle 124; thereby, enabling the outlet connector 324 to remain stationary when the output states of the third embodiment 310 are changed.

The valve assembly 120 of the fourth embodiment 410 could be replaced with the valve assembly 320 and connected to the conventional sprinkler 70 as with the third embodiment 310.

The sprinkler head assembly 150 of the fourth embodiment 410 could be eliminated and have the user supply and connect a sprinkler head to the outlet connector 140 of the valve assembly 120, as with the second embodiment 210.

The rotary valve member 126 can have more than one passageway 144, thus permitting more off state, on state and off state sequences per revolution of the valve member 126 about the valve housings 122, 322, 522 and 722.

The inlet connection or the inlet connector 128 can be of any type suited for connection to a hose, for example hose 30, including a threaded connector or connection, a quick connector or connection, a clamp connector or connection, a removable connector or connection, a permanent connection or connection, etc.

The outlet connections or the outlet connectors 140 and 324 can be of any type including threaded connectors or connections, quick connectors or connections, clamp connectors or connections, removable connectors or connections, permanent connectors or connections, etc.

The wheel configured valve support or the rotary valve support 532 can have any configuration that rotates about a center axis and engages with the lawn 40 and the ground 50.

The rotary valve support 532 can be sufficiently elongated along its rotating axis so that it adequately supports and stabilizes the valve assemblies 520 and 720 on the lawn 40 and the ground 50; thereby, eliminating the requirement for the side valve support assembly 540.

The side valve support assembly 540 can be eliminated and replaced with a rotary valve support assembly similar to the rotary valve support assembly 530.

A spring loaded ratcheting mechanism to automatically advance the rotary valve member 126 about the valve housings 122, 322, 522 and 722 to off state, on state and off state sequences when the hose 30 is pulled can be added to the valve assemblies 120, 320, 520 and 720.

It was stated in the description of the fifth embodiment 510, that the fifth embodiment 510 has 3 valve supports, namely, the rotary valve support 532, the side valve support 542 and the valve housing 522, at valve housing location 526; however, the third valve support inherent in the configuration of the valve housing 522 at location 526 could be eliminated with the inlet connector 128 placed closer to the housing cavity 142, because the connected supply hose 30 would provide the third support required for stability; therefore, the fifth embodiment 510 itself would have only 2 valve supports. The elimination of the valve housing 522 support provided at the valve housing location 526 also applies to the sixth embodiment 610 and the seventh embodiment 710.

With the elimination of the valve housing 522 support at the valve housing location 526 and with the rotary valve support 532 sufficiently elongated along its rotating axis, thus eliminating the requirement for the side valve support assembly 540, the fifth embodiment 510, the sixth embodiment 610 and the seventh embodiment 710 require only one valve support, namely the elongated rotary valve support 532.

Accordingly, the scope and meaning should be determined not only by the embodiments illustrated, but by the appended claims and their legal equivalents.

I claim:

1. A hose controlled sprinkler device whose sequential liquid output states can be remotely controlled by a substantially unidirectional movement of a sprinkler device connected hose, the hose controlled sprinkler device comprising:

a valve, said valve including:

a moveable member, a valve housing, an inlet connector configured for connection to the hose, and an outlet;

said valve configured to have at least one output sequence at said outlet, said sequence comprising a liquid off state to a liquid on state to a liquid off state, said sequence being established by a pressurized liquid input at said inlet connector and further by a unidirectional movement of one of said movable member and said valve housing about the other; and at least one valve support, said at least one valve support connected to said valve and configured to stabilize said valve above at least one of a ground and a lawn;

whereby, the sequential liquid output states of the hose controlled sprinkler device, disposed on at least one of said ground and said lawn, can be remotely controlled by the substantially unidirectional movement of the hose which is both connected to said inlet connector and supplies said inlet connector with a pressurized liquid.

2. The device of claim 1 wherein said at least one valve support is limited to at least three valve supports, and wherein said at least three valve supports are connected to said movable member and configured to engage with at least one of said ground and said lawn, whereby, a user can connect the hose to said inlet connector, dispose the hose controlled sprinkler device on at least one of said ground and said lawn, pressurize the hose with said liquid, partially curve the hose around said at least three valve supports and move the hose in a substantially single direction to unidirectionally rotate said housing with respect to said moveable member, thereby, controlling the sequential output states of the hose controlled sprinkler device.

3. The device of claim 1 wherein at least one valve support of said at least one valve support is configured as a rotary valve support, and wherein said rotary valve support is connected to said moveable member and further configured to engage at least one of said ground and said lawn, whereby, a user can connect the hose to said inlet connector, dispose the hose controlled sprinkler device on at least one of said ground and said lawn, pressurize the hose with said liquid, and move the hose in a substantially single direction to rotate said rotary valve support and unidirectionally move said moveable member with respect to said housing, thereby, controlling the sequential output states of the hose controlled sprinkler device.

4. The device of claim 2 further including a sprinkler wherein said sprinkler is connected to said outlet, whereby, the sequential liquid output states of said sprinkler can be remotely controlled by the substantially unidirectional movement of the hose.

5. The device of claim 3 further including a sprinkler wherein said sprinkler is connected to said outlet, whereby, the sequential liquid output states of said sprinkler can be remotely controlled by the substantially unidirectional movement of the hose.

6. The device of claim 1 wherein said valve is selected from a group including; a ball valve, a plug valve, a butterfly valve, a cock valve, a pinch valve a control valve, and a crank valve.

7. The device of claim 1 wherein said outlet is further configured as one of an outlet connector and an outlet connection and wherein said inlet connector and said outlet are selected from a group including; threaded connectors and connections, quick connectors and connections, clamp connectors and connections, removable connectors and connections, and permanent connectors and connections.

8. A hose controlled sprinkler device whose sequential liquid output states can be remotely controlled by a substantially unidirectional pulling of a sprinkler device connected hose, the hose controlled sprinkler device comprising:

a rotary valve, said rotary valve including:

a rotary member and a valve housing, said valve housing having an inlet connector configured for connection to the hose, an outlet connector and a housing passageway extending therethrough between said inlet connector and said outlet connector, said rotary member disposed and rotatable at least in part within said valve housing and said housing passageway and configured to rotatably open and close said housing passageway;

said rotary valve configured to have at least one output sequence at said outlet connector, said sequence comprising a liquid off state to a liquid on state to a liquid off state, said sequence being produced by a pressurized liquid input at said inlet connector and further by a unidirectional rotation of one of said rotary member and said valve housing about the other; and at least one valve support, said at least one valve support connected to said rotary valve and configured to stabilize said rotary valve above at least one of a ground and a lawn;

whereby, the sequential liquid output states of the hose controlled sprinkler device, disposed on at least one of said ground and said lawn, can be remotely controlled by the substantially unidirectional pulling of the hose which is both connected to said inlet connector and supplies said inlet connector with a pressurized liquid.

9. The device of claim 8 wherein said at least one valve support is limited to at least three valve supports, and wherein said at least three valve supports are connected to said rotary member and configured to engage with at least one of said lawn and said ground, whereby a user can connect the hose to said inlet connector, dispose the hose controlled sprinkler device on at least one of said ground and said lawn, pressurize the hose with said liquid, partially curve the hose around said at least three valve supports and pull the hose in a substantially single direction to unidirectionally rotate said housing about said rotary member, thereby, controlling the sequential output states of the hose controlled sprinkler device.

10. The device of claim 8 wherein at least one valve support of said at least one valve support is configured as a rotary valve support, and wherein said rotary valve support is connected to said rotary member and is further configured to engage with at least one of said ground and said lawn, whereby a user can connect the hose to said inlet connector, dispose the hose controlled sprinkler device on at least one of said ground and said lawn, pressurize the hose with said liquid, and pull the hose in a substantially single direction to rotate said rotary valve support and thus, unidirectionally rotate said rotary member about said housing, thereby, controlling the sequential output states of the hose controlled sprinkler device.

11. The device of claim 9 further including a sprinkler, and wherein said sprinkler is connected to said outlet connector, whereby, the sequential liquid output states of said sprinkler can be remotely controlled by the substantially unidirectional pulling of the hose.

12. The device of claim 10 further including a sprinkler, and wherein said sprinkler is connected to said outlet connector, whereby, the sequential liquid output states of said sprinkler can be remotely controlled by the substantially unidirectional pulling of the hose.

13. The device of claim 8 wherein said rotary valve is selected from a group including: a ball valve, a plug valve, a butterfly valve, a pinch valve, a cock valve, a control valve and a crank valve, and wherein said inlet connector and said outlet connector are selected from a group including: threaded connectors, quick connectors, clamp connectors, removable connectors and permanent connectors.

14. The device of claim 8 wherein said rotary member further includes a passageway extending therethrough, whereby, when said passageway misaligns, then aligns and then misaligns with said housing passageway, during rotation of one of said rotary member and said valve housing about the other, the output states of said rotary valve at said outlet connector are a liquid off state, a liquid on state and a liquid off state, respectively.

15. A method for remotely controlling the sequential liquid output states of a hose pressurized with a liquid, the method comprising the steps of:

(a) providing a hose controlled sprinkler device whose sequential liquid output states can be remotely controlled by a substantially unidirectional movement of the hose connected to said sprinkler device, said hose controlled sprinkler device including:

a valve, said valve including:

a moveable member, a valve housing, an inlet connector configured for connection to the hose, and an outlet;

said valve configured to have at least one output sequence at said outlet, said sequence comprising a liquid off state to a liquid on state to a liquid off state, said sequence being established by a pressurized liquid input at said inlet connector and further by a unidirectional movement of one of said movable member and said valve housing about the other; and at least one valve support, said at least one valve support connected to said valve and configured to stabilize said valve above at least one of a ground and a lawn;

(b) providing the hose pressurized with a liquid and connected to said inlet connector of said hose controlled sprinkler device;

(c) moving the hose in a direction to enable said off state of said valve;

(d) moving the hose substantially in said direction to enable said on state of said valve; and (e) moving said hose again substantially in said direction to enable said off state of said valve;

whereby, the sequential liquid output states of the hose can be remotely controlled by a substantially unidirectional movement of the hose.

16. The method of claim 15 wherein said hose controlled sprinkler device further includes a sprinkler connected to said outlet of said valve, whereby, the sequential liquid output states of said sprinkler can be remotely controlled by said substantially unidirectional movement of the hose.

17. The method of claim 15 further including a step of connecting a sprinkler to said outlet of said valve, whereby, the sequential liquid output states of said sprinkler can be remotely controlled by said substantially unidirectional movement of the hose.

18. The method of claim 15 wherein said at least one valve support is limited to at least three valve supports, and said at least three valve supports are connected to said movable member and configured to engage with at least one of a ground and a lawn.

19. The method of claim 15 wherein at least one valve support of said at least one valve support is configured as a rotary valve support, and wherein said rotary valve support is connected to said moveable member and further configured to engage with at least one of a ground and a lawn.

20. The method of claim 15 wherein said valve is selected from a group including: a ball valve, a plug valve, a butterfly valve, a pinch valve, a cock valve, a control valve and a crank valve, further wherein said outlet is configured as one of an outlet connector and an outlet connection, and still further wherein said inlet connector and said outlet are selected from a group including: threaded connectors and connections, quick connectors and connections, clamp connectors and connections, removable connectors and connections and permanent connectors and connections.

21. An on-off valve control system for placement between a sprinkler and a sprinkler supply hose, said on-off valve control system comprising: a supply hose, an on-off valve, said on-off valve including two portions configured for rotation with respect to each other, said rotation affecting the output states of said on-off valve; a valve support for both mounting one portion of said two portions thereupon and stabilizing said on-off valve above at least one of a ground and a lawn; said rotation being established by the substantially unidirectional pulling of the sprinkler supply hose against said valve support, said rotation further affecting the output states of said on-off valve in at least one sequence, said sequence comprising a liquid off state to a liquid on state to a liquid off state; whereby, when the supply hose is pulled with respect to said valve support in a substantially single direction, one portion of said two portions of said on-off valve will unidirectionally rotate with respect to the other portion, thereby, changing the output states of said on-off valve and enabling or disabling the flow of liquid through the sprinkler supply hose to the sprinkler.

* * * * *